US005206208A

United States Patent [19]

Liang et al.

[11] Patent Number: 5,206,208

[45] Date of Patent: Apr. 27, 1993

[54] STABILIZATION OF THERMAL IMAGES

[75] Inventors: Rong C. Liang, Lexington; William C. Schwarzel, Billerica; Rita S. Shon Baker, Brookline; Robert P. Short, Arlington; Stephen R. Sofen, Lexington; Michael A. Young, Natick, all of Mass.

[73] Assignee: Polaroid Corporation, Cambridge, Mass.

[21] Appl. No.: 795,101

[22] Filed: Nov. 20, 1991

[51] Int. Cl.[5] ..... B41M 5/30

[52] U.S. Cl. ..... 503/201; 106/21 R; 427/151; 430/200; 503/204; 503/209; 503/211; 503/212; 503/218; 503/221

[58] Field of Search ..... 430/200, 201; 503/201, 503/202, 217, 218, 219, 225, 204, 209, 211, 212, 221; 106/21; 427/150–152

[56] References Cited

U.S. PATENT DOCUMENTS

| | | | |
|---|---|---|---|
| Re. 32,195 | 7/1986 | Herz | 430/445 |
| 3,445,234 | 5/1969 | Cescon et al. | 96/90 |
| 3,658,543 | 4/1972 | Gerlach, Jr. et al. | 96/90 |
| 3,864,146 | 2/1975 | Oda et al. | 117/36.8 |
| 3,993,637 | 11/1976 | Straley et al. | 260/157 |
| 4,052,218 | 10/1977 | Samat et al. | 96/114 |
| 4,054,684 | 10/1977 | Ceintrey et al. | 427/54 |
| 4,262,938 | 4/1981 | Yamaguchi et al. | 282/27.5 |
| 4,341,860 | 7/1982 | Sysak | 430/277 |
| 4,356,250 | 10/1982 | Irani et al. | 430/216 |
| 4,370,401 | 1/1983 | Winslow et al. | 430/178 |
| 4,456,674 | 6/1984 | Ceranowski et al. | 430/221 |
| 4,478,926 | 10/1984 | Muller et al. | 430/178 |
| 4,496,651 | 6/1985 | Ceranowski et al. | 430/490 |
| 4,556,687 | 12/1985 | Maierson | 524/333 |
| 4,602,263 | 7/1986 | Borrer et al. | 246/201 |
| 4,614,757 | 9/1986 | Maierson | 524/333 |
| 4,622,286 | 11/1986 | Sheets | 430/343 |
| 4,636,819 | 1/1987 | Nagamoto et al. | 346/216 |
| 4,670,374 | 6/1987 | Bellus et al. | 430/505 |
| 4,687,728 | 8/1987 | Folkard et al. | 430/270 |
| 4,704,344 | 11/1987 | Aono et al. | 430/203 |
| 4,716,424 | 12/1987 | Petitpierre et al. | 503/210 |
| 4,720,449 | 1/1988 | Borrer et al. | 430/338 |
| 4,720,450 | 1/1988 | Ellis | 430/339 |
| 4,745,046 | 5/1988 | Borrer et al. | 430/332 |
| 4,803,148 | 2/1989 | Harada et al. | 430/138 |
| 4,826,976 | 5/1989 | Borrer et al. | 544/58.4 |
| 4,839,272 | 6/1989 | Ohmatsu et al. | 430/617 |
| 4,871,713 | 10/1989 | Matsuoka et al. | 503/209 |
| 4,876,233 | 10/1989 | Saeki et al. | 503/209 |
| 4,880,723 | 11/1989 | Harai et al. | 430/218 |
| 4,888,322 | 12/1989 | Saito et al. | 503/215 |
| 4,889,756 | 12/1989 | Barzynski et al. | 428/64 |
| 4,895,827 | 1/1990 | Vervacke et al. | 503/210 |
| 4,959,291 | 9/1990 | Harada et al. | 430/138 |
| 4,960,901 | 10/1990 | Borrer et al. | 548/207 |
| 4,983,670 | 1/1991 | Yates et al. | 525/54.2 |
| 4,985,392 | 1/1991 | Bjork | 503/211 |
| 4,986,921 | 1/1991 | Yates et al. | 210/758 |
| 5,008,237 | 4/1991 | Liang et al. | 503/212 |
| 5,017,546 | 5/1991 | Brinkman et al. | 503/211 |
| 5,024,987 | 6/1991 | Klug et al. | 503/211 |

*Primary Examiner*—Pamela R. Schwartz
*Attorney, Agent, or Firm*—David J. Cole

[57] ABSTRACT

The addition, to a thermal imaging medium comprising a color-forming compound which undergoes a change of color upon heating above a color-forming temperature for a color-forming time, the color-forming compound being of the cyclic sulfonamide type described in U.S. Pat. Nos. 4,720,449 and 4,960,901, of a source of zinc, nickel, copper(II), cobalt(II) or aluminum(III) cations increases the sensitivity of the imaging medium and helps to prevent fading of images produced therefrom while the images are being projected.

36 Claims, 9 Drawing Sheets

STABILIZATION OF THERMAL IMAGES

BACKGROUND OF THE INVENTION

1. Field of the Invention

This invention relates to stabilization of thermal images. More particularly, this invention relates to thermal imaging media, processes for forming images and imaged media in which metal cations are used to reduce fading of the images during projection of the image by passage of visible radiation through the image. The sensitivity of some of the thermal imaging media of the invention is improved by the incorporation of the metal cations therein.

2. References to Related Applications

Copending patent application U.S. Ser. Nos. 07/695,641; 07/696,196 and 07/695,932 (now U.S. Pat. No. 5,153,169), all filed May 6, 1991 and all assigned to the same assignee as the present application, describe and claim imaging media comprising a color-forming layer comprising a thermal color-forming composition adapted to undergo a change of color upon increase in the temperature of the color-forming layer above a color-forming temperature for a color-forming time. Preferred imaging media described in these three applications are substantially as shown in FIG. 1 of the accompanying drawings and comprise three separate color-forming layers containing yellow, cyan and magenta thermal color-forming compositions; each of these color-forming compositions comprises a color-forming compound which can produce the desired color and an infra-red absorber capable of absorbing infra-red radiation and thereby generating heat in the color-forming layer. The three color-forming layers use infra-red absorbers absorbing at differing wavelengths so that each color-forming layer can be imaged independently; for example, specific imaging media disclosed in these three applications use infra-red absorbers having peak absorptions at approximately 792, 822 and 869 nm.

Copending application U.S. Ser. No. 07/696,222, filed May 6, 1991, and assigned to the same assignee as the present application, describes and claims certain processes for the synthesis of bis(heterocyclic) dyes, especially asymmetric dyes in which the two heterocyclic nuclei differ. These processes are useful for the synthesis of certain infra-red dyes used in the imaging medium of the present invention shown in FIG. 1 of the accompanying drawings.

Copending application U.S. Ser. No. 07/795,038, of even date herewith and assigned to the same assignee as the present application, describes and claims certain bis(benzpyrylium) infra-red dyes, including the croconate dye used in the thermal imaging medium described below with reference to FIG. 1 of the accompanying drawings.

Copending application U.S. Ser. No. 07/795,034, of even date herewith and assigned to the same assignee as the present application, describes and claims certain amino-substituted squarylium infra-red dyes, including the dyes of Formulae IR2, IR3 and IR5 used in the thermal imaging medium described below with reference to FIG. 1 of the accompanying drawings.

Copending application U.S. Ser. No. 07/696,151, filed May 6, 1991, and assigned to the same assignee as the present application, describes and claims leuco dyes which can be used in the imaging medium of the present invention.

Copending application U.S. Ser. No. 07/277,014 (now abandoned), filed Nov. 28, 1988, and assigned to the same assignee as the present application, describes and claims the yellow leuco dye used in the imaging medium of the present invention shown in FIG. 1 of the accompanying drawings.

U.S. Pat. No. 5,063,090, assigned to the same assignee as the present application, describes and claims quinophthalone leuco dyes which can be used in the imaging medium of the present invention.

Copending application U.S. Ser. No. 07/795,102 of even date herewith and assigned to the same assignee as the present application describes and claims thermal imaging media generally similar to those of the present invention, but in which quinones and hydroquinones, rather than certain metal cations, are used to increase the sensitivity of, and reduce fading of images formed from, the imaging media.

The disclosures of all the aforementioned copending applications are herein incorporated by reference.

3. Description of the Prior Art

As already indicated, imaging media are known which have at least one color-forming layer comprising a color-forming composition adapted to undergo a change of color (from colorless to colored, from colored to colorless, or from one color to another) upon increase in the temperature of the color-forming layer above a color-forming temperature for a color-forming time. The color change in such media need not be supplied by applying heat directly to the medium; the color-forming composition may comprise a color-forming compound (also referred to herein as a "leuco dye") which undergoes a change of color upon heating above a color-forming temperature, and an absorber capable of absorbing actinic (usually infra-red) radiation and thereby generating heat in the color-forming layer. When such a medium is exposed to appropriate actinic radiation, this radiation is absorbed by the absorber, thereby heating the color-forming compound and causing it to undergo its color change. Many such thermal imaging media have the advantage over conventional silver halide media of not requiring a post-exposure developing step. Such thermal imaging media also have the advantage that they are essentially insensitive to visible light, so that they can be handled under normal lighting conditions.

For example U.S. Pat. Nos. 4,602,263 and 4,826,976 both describe thermal imaging systems for optical recording and particularly for forming color images. These thermal imaging systems rely upon the irreversible unimolecular fragmentation of one or more thermally unstable carbamate moieties of an organic compound to effect a visually discernible color shift. U.S. Pat. Nos. 4,720,449 and 4,960,901 describe a similar imaging system in which the color-developing component is a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored. Other thermal imaging systems using di- or triarylmethane compounds are described in U.S. Pat. No. 4,720,450, while U.S. Pat. No. 4,745,046 describes a thermal imaging system using as color-forming co-reactants a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which, upon heating and contacting the di- or triarylmethane compound, undergoes a bimolecular nucleophilic substitution reaction with the nucleophilic moiety to form a colored, ring-opened di- or triarylmethane compound.

The aforementioned patents describe a preferred form of imaging medium for forming multicolor images; in this preferred imaging medium, three separate color-forming layers, capable of forming yellow, cyan and magenta dyes, respectively, are superposed on top of one another. Each of the three color-forming layers has an infra-red absorber associated therewith, these absorbers absorbing at differing wavelengths, for example 760, 820 and 880 nm. This medium is imagewise exposed to three lasers having wavelengths of 760, 820 and 880 nm. (In the present state of technology, solid state diode lasers emitting at about 760 to 1000 nm provide the highest output per unit cost. Since most of the color-forming materials described in the aforementioned patents do not have high extinction coefficients within this wavelength range, it is necessary to include the infra-red absorbers with the leuco dyes in order to ensure efficient absorption of the laser radiation and hence efficient heating of the leuco dye.) The resultant imagewise heating of the color-forming layers causes the leuco dyes to undergo color changes in the exposed areas, thereby producing a multicolored image, which needs no development.

This preferred type of imaging medium is capable of very high resolution images; for example, the medium can readily be used to produce a 2K line 35 mm slide (i.e., a slide having 2000 pixels in each line parallel to the long edges of the slide). However, it has been found that images produced from certain leuco dyes, especially those described in the aforementioned U.S. Pat. Nos. 4,720,449 and 4,960,901, tend to fade and/or undergo color shifts when those images are projected using powerful conventional slide projectors, for example xenon arc projectors, for extended periods of time. Obviously, fading and color shifts are undesirable and the need therefore exists for ways of preventing or at least reducing such fading and color shifts.

The thermal color-forming reactions described in the aforementioned patents do not provide any amplification such as occurs in silver halide based imaging media, and consequently the media are relatively insensitive; typically, the thermal media require energy inputs of about 1 J/cm$^2$ per color-forming layer to achieve maximum transmission optical densities around 3.0, which are needed for acceptable slides. Accordingly, it would be advantageous to improve the sensitivity of these thermal imaging media so as to improve the speed of image formation and/or reduce the power requirements for the energy source used for imaging.

It has now been found that certain metal cations reduce the fading and color shifts which otherwise occur during projection of thermal images produced as described in the aforementioned U.S. Pat. Nos. 4,720,449 and 4,960,901, and also serve to increase the sensitivity of the thermal imaging media described in these patents.

SUMMARY OF THE INVENTION

Accordingly, this invention provides a thermal imaging medium comprising at least one imaging layer, the imaging layer comprising a color-forming compound which undergoes a change of color upon heating above a color-forming temperature for a color-forming time, the color-forming compound being of the formula:

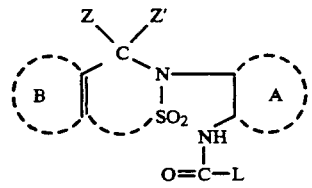

(I)

and forming after its change in color a dye compound of the formula:

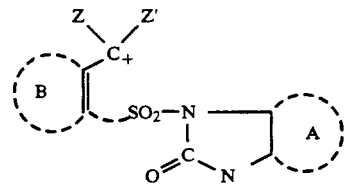

(II)

in which formulae:

rings A and B are aromatic nuclei;

Z and Z', which may be linked other than via the meso carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, the imaging layer further comprising a source of zinc, nickel, copper(II), cobalt(II) or aluminum(III) cations.

The term "meso carbon atom" is used herein in its conventional sense to refer to the carbon atom bonded to the groups Z and Z' in the compounds of Formula I and II.

This invention also provides a process for forming an image, the process comprising:

providing a thermal imaging medium having at least one imaging layer, the imaging layer comprising a color-forming compound of Formula I above and a source of zinc, nickel, copper(II), cobalt(II) or aluminum(III) cations;

imagewise heating the imaging layer above a color-forming temperature for a color-forming time, thereby causing, in heated regions of the image, at least part of the color-forming compound to be converted to a dye compound of Formula II above, thereby forming an image.

Finally, this invention provides an imaged medium having imagewise colored and substantially uncolored areas, the substantially uncolored areas of the image comprising a color-forming compound which undergoes a change of color upon heating above a color-forming temperature for a color-forming time, the color-forming compound being of Formula I above and the colored areas of the image comprising a dye compound of Formula II above, the colored and substantially uncolored areas further comprising a source of zinc, nickel, copper(II), cobalt(II) or aluminum(III) cations.

DETAILED DESCRIPTION OF THE INVENTION

Figure 1:
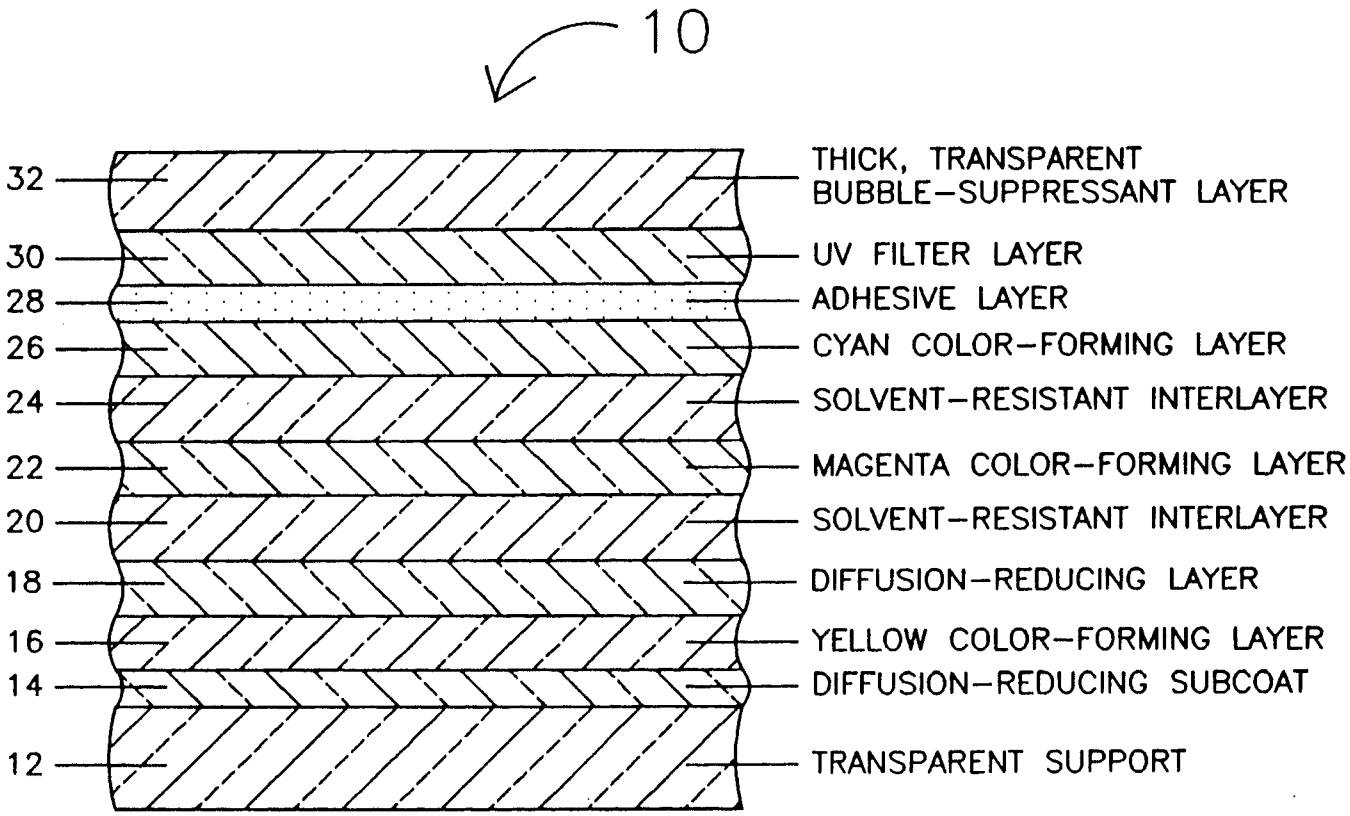
FIG. 1 of the accompanying drawings shows a schematic cross-section through a preferred imaging medium of the present invention.

As already mentioned, the thermal imaging medium of the present invention comprises a color-forming compound of Formula I (which, upon heating above a color-forming temperature for a color-forming time, forms a dye compound of Formula II) and a source of zinc, nickel, copper(II), cobalt(II) or aluminum(III) cations. Mixtures of such cations may be employed if desired, provided of course that the sources of the cations are compatible with one another.

In general, it is preferred to use zinc rather the other metal cations in the imaging medium and process of the present invention. With sensitive color-forming compounds, zinc will typically increase the sensitivity of the medium at least about 30 percent. However, as illustrated in Example 5 below, certain relatively insensitive color-forming compounds, which in the absence of zinc image so slowly that they are impractical for use in any commercially-useful imaging medium, are increased in sensitivity several hundred per cent by the addition of zinc. Appropriate zinc salts are readily available and inexpensive. In addition, zinc tends to be less likely than other cations to form unwanted colored complexes with other components of the imaging medium.

The source of metal cations used in the present imaging medium can be any metal compound which can be dispersed at the required concentration in the imaging layer and which does not adversely affect any of the components of that layer. The imaging layer normally contains a polymeric binder and this polymeric binder typically restricts the sources of metal cations which can be used, since many inorganic metal salts cannot be dispersed at high concentrations in polymeric binders and/or adversely affect such binders. In general, it is recommended that strongly acidic salts, for example, zinc salicylate, benzoate, ascorbate and phenolsulfonate, be avoided, since these acidic salts may cause undesirable color formation of the color-forming compound during storage at ambient temperature. Zinc chloride and zinc nitrate are also sufficiently acidic to cause undesirable color formation in some leuco dyes, and hence are not recommended for use in the present invention. Preferred metal sources are metal carboxylates; zinc acetate and isobutyrate are especially preferred because of their low cost and low molecular weight, which reduces the amount of the salt which has to be included in the imaging layer to provide a given amount of zinc cation. The use of lower carboxylates containing less than about 8 carbon atoms is preferred, since higher carboxylates, which are waxy materials, tend not to give clear layers; for example, it has been found that zinc stearate is too waxy to give a clear coating. Nickel, aluminum, copper(II) and cobalt(II) are all conveniently supplied as their acetates.

Another preferred source of zinc and/or nickel in the imaging media of the present invention is zinc and nickel rosinates, also known commercially as zinc and nickel resinates. These materials are rosin-based zinc and nickel salts with good solubility in the polymeric binders typically used in thermal imaging media. Rosin consists mainly of abietic acid, with minor proportions of hydrogenated abietic acids and other materials. Examples of rosinates which are available commercially and are useful in the present imaging media are the materials sold under the registered trademarks Zirex, Zinar, Zitro and Polytac100 by Arizona Chemical Company, 1001 East Business Highway 98, Panama City, Fla. 32401. The zinc derivatives described in U.S. Pat. No. 5,008,237 may also be used.

The rate of projector fading and/or color shifting experienced with the imaged medium of the present invention varies considerably with the polymeric binder used in the imaging layer, and thus the optimum amount of metal cation to be used in the imaging layer is best determined empirically. In general, however, it is preferred that the source of metal cations provide at least about 0.1, and desirably at least about 0.25, mole of metal cation per mole of color-forming compound. It should be noted that there is a metal cation/color-forming compound ratio above which further increases in the ratio do not appear to produce further increases in sensitivity or protection against projector fading, although the exact ratio at which this occurs will vary with the specific metal and color-forming compound used.

The color change undergone by the color-forming compound during imaging of the thermal imaging medium of the present invention may be of any of the types previously mentioned (i.e., from colorless to colored, from colored to colorless, or from one color to another), but in general it is preferred that the color change be from colorless to colored. The term "colored" as used herein is not restricted to colors visible to the human eye; although the present invention may find its chief application in imaging media intended for the production of visible images, it may also be used in imaging media intended for the production of "images" which can only be read at non-visible (for example, infra-red) wavelengths.

Preferred color-forming compounds of Formula I are those in which Z and Z' each comprise a benzene ring, Z and Z' being linked via an oxygen atom bonded to the two benzene rings at positions ortho to the meso carbon atom, so that the Z-C-Z' grouping forms a xanthene nucleus. Especially preferred compounds of this type are those in which the benzene rings of Z and Z' carry substituted amino groups at positions para to the meso carbon atom. It is also preferred that, in the color-forming compounds of Formula I, ring A comprise a benzene ring bearing, at its position para to the sulfonamide nitrogen atom, a carbamate moiety.

Two specific preferred color-forming compounds of Formula I are:

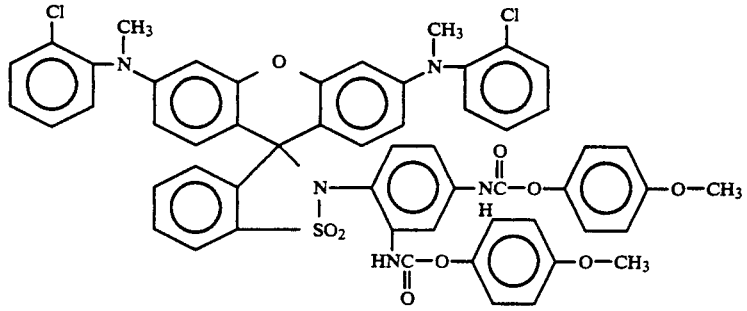

(III)

and

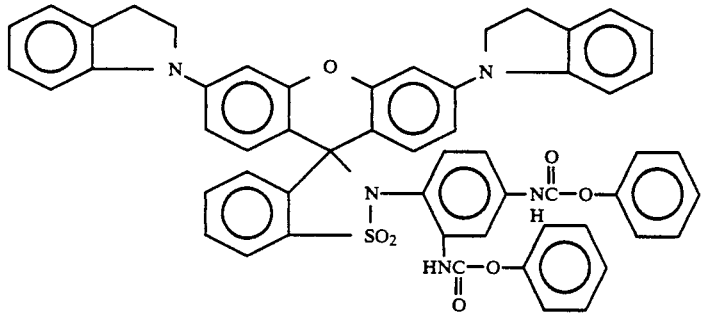

(IV)

Except for the presence of the source of metal cations, the various layers of the imaging medium of the present invention, and the techniques used for exposing the medium, can be those used in the aforementioned U.S. patents and applications. Thus, in carrying out the imaging method of the present invention, heat may be applied or induced imagewise in a variety of ways. Preferably, selective heating is produced in the color-forming layer itself by the conversion of electromagnetic radiation into heat, and preferably the light source is a laser emitting source such as a gas laser or semiconductor laser diode, preferably an infra-red laser. The use of a laser beam is not only well suited for recording in a scanning mode but by utilizing a highly concentrated beam, radiant energy can be concentrated in a small area so that it is possible to record at high speed and high density. Also, it is a convenient way to record data as a heat pattern in response to transmitted signals, such as digitized information.

Since most of the color-forming compounds used in the present imaging medium do not absorb strongly in the infra-red, in the imaging medium of the present invention the imaging medium desirably comprises an absorber capable of absorbing infra-red radiation and thereby generating heat in the imaging layer. The heat thus generated is transferred to the color-forming compound to initiate the color-forming reaction and effect the change in the absorption characteristics of the color-forming compound from colorless to colored. Obviously, the infra-red absorber (which may also be referred to hereinafter as an "infra-red dye") should be in heat-conductive relationship with the color-forming compound, for example, in the same layer as the color-forming compound or in an adjacent layer. Though an inorganic compound may be employed, the infra-red absorber preferably is an organic compound, such as a cyanine, merocyanine, squarylium, thiopyrylium or benzpyrylium dye, and preferably, is substantially non-absorbing in the visible region of the electromagnetic spectrum so that it will not contribute any substantial amount of color to the $D_{min}$ areas, i.e., the highlight areas of the image. The light absorbed by the respective infra-red absorbers is converted into heat and the heat initiates the reaction to effect the formation of colored compounds in the color-forming layers. Since this type of imaging medium is imaged by infra-red radiation rather than by direct heating, a high resolution image is more easily achieved.

An especially preferred form of imaging medium of the present invention has at least two imaging layers, the at least two imaging layers comprising color-forming compounds arranged to produce dye compounds having differing colors, and comprising absorbers absorbing at differing wavelengths. The infra-red absorbers are desirably selected such that they absorb radiation at different predetermined wavelengths above 700 nm sufficiently separated so that each color-forming layer may be exposed separately and independently of the others by using infra-red radiation at the particular wavelengths selectively absorbed by the respective infra-red absorbers. As an illustration, three color-forming layers containing yellow, magenta and cyan color-forming compounds could have infra-red absorbers associated therewith that absorb radiation at 792 nm, 848 nm and 926 nm, respectively, and could be addressed by laser sources, for example, infra-red laser diodes, emitting laser beams at these respective wavelengths so that the three color-forming layers can be exposed independently of one another. While each layer may be exposed in a separate scan, it is usually preferred to expose all of the color-forming layers in a single scan using multiple laser sources of the appropriate wavelengths. Instead of using superimposed imaging layers, the color-forming compounds and associated infra-red absorbers may be arranged in an array of side-by-side dots or stripes in a single recording layer. In such multicolor imaging media, the color-forming compounds may comprise the subtractive primaries yellow, magenta and cyan or other combinations of colors, which combinations may additionally include black. The leuco dyes generally are selected to give the subtractive colors cyan, magenta and yellow, as commonly employed in photographic processes to provide full natural color. A full color imaging medium of this type having three imaging layers is described below with reference to FIG. 1 of the accompanying drawings.

Where imagewise heating is induced by converting light to heat, the imaging medium may be heated prior to or during exposure. This may be achieved using a heating platen or heated drum or by employing an additional laser source or other appropriate means for heating the medium while it is being exposed.

The imaging medium of the present invention can be prepared in a manner similar to the imaging media described in the aforementioned U.S. patents and applications. Typically, the color-forming compound and any other components of the imaging layer (for example, a polymeric binder and an infra-red absorber) are dispersed in an appropriate solvent, and the resultant liquid dispersion is coated onto a support, generally a polymer film, using conventional coating equipment, and the resultant liquid film dried to produce the imaging layer. Rather than a solution coating, the layer may be applied as a dispersion or an emulsion. The coating composition also may contain dispersing agents, plasticizers, defoaming agents, hindered amine light stabilizers and coating aids. In forming the imaging layer(s) and the interlayers or other layers, temperatures should be maintained below levels that will cause the color-forming reactions to occur rapidly so that the color-forming compounds will not be prematurely colored.

To incorporate a source of metal cations into the imaging layer in accordance with the present invention, the source is simply dispersed in the liquid dispersion with the other components of the imaging layer. Thus, the present invention does not require extensive changes in the equipment or processes used to produce the thermal imaging medium.

Apart from the presence of the metal cations, the imaging medium of the present invention may contain additional layers and components as described in the aforementioned U.S. patents and applications. Thus, as already indicated, the imaging medium typically includes a support on which the imaging layer(s) are deposited. The support should be sufficiently thick as to permit easy handling of the imaging medium, and may be any material that substantially retains its dimensional stability during imaging. Desirably, the support has a thickness of at least about 50 μm. The support must be sufficiently transparent that it does not raise excessively the $D_{min}$ of the final image. If it is desired to image through the support, the support must also be sufficiently transparent that it does not interfere with the imaging process, and is preferably non-birefringent, since if the medium is imaged through the support, a birefringent support may cause difficulties in focussing the laser (or other radiation source) at the proper level within the imaging medium. Suitable supports include polyethylene, polypropylene, polycarbonate, cellulose acetate, and polystyrene. The preferred material for the support is a polyester, desirably poly(ethylene terephthalate).

Examples of binders that may be used include poly(vinyl alcohol), poly(vinyl pyrrolidone), methyl cellulose, cellulose acetate butyrate, styrene-acrylonitrile copolymers, copolymers of styrene and butadiene, poly(methyl methacrylate), copolymers of methyl and ethyl acrylate, poly(vinyl acetate), poly(vinyl butyral), polyurethane, polycarbonate and poly(vinyl chloride). It will be appreciated that the binder selected should not have any adverse effect on the leuco dye incorporated therein and may be selected to have a beneficial effect. Also, the binder should be substantially heat-stable at the temperatures encountered during image formation and it should be transparent so that it does not interfere with viewing of the color image. Where electromagnetic radiation is employed to induce imagewise heating, the binder also should transmit the light intended to initiate image formation.

As explained in more detail in the aforementioned copending application U.S. Ser. No. 07/696,196, in some imaging media of the type described in the aforementioned patents, there is a tendency for one or more of the colored materials produced during imaging to diffuse out of their color-forming layers, but such undesirable diffusion of colored material can be reduced or eliminated by dispersing the leuco dye in a first polymer having a glass transition temperature of at least about 50° C., preferably at least about 75° C., and most preferably at least about 95° C., and providing a diffusion-reducing layer in contact with the color-forming layer, this diffusion-reducing layer comprising a second polymer having a glass transition temperature of at least about 50° C. and being essentially free from the color-forming composition. Desirably, the diffusion-reducing layer has a thickness of at least about 1 μm. The first polymer is desirably an acrylic polymer, preferably poly(methyl methacrylate).

As discussed in the aforementioned application U.S. Ser. No. 07/695,641, certain color-forming compounds show a tendency to form bubbles during imaging. Accordingly, the imaging medium of the present invention advantageously comprises a bubble-suppressant layer superposed on the imaging layer and having a thickness of at least about 10 μm, such that, upon imagewise increase in the temperature of the imaging layer above the color-forming temperature for the color-forming time, in heated regions the imaging layer undergoes its change of color but remains essentially free from bubbles.

Other layers which may be included in the imaging medium of the present invention are, for example, a subbing layer to improve adhesion to a support, interlayers for thermally insulating the imaging layers from each other, an ultra-violet screening layer having an ultraviolet absorber therein, or other auxiliary layers. To give good protection against ultra-violet radiation, ultra-violet screening layers are desirably provided on both sides of the imaging layer(s); conveniently, one of the ultra-violet screening layers is provided by using as the support a polymer film containing an ultra-violet absorber, and such absorber-containing films are available commercially.

A preferred embodiment of the invention will now be described, though by way of illustration only, with reference to FIG. 1 of the accompanying drawings, which is a schematic cross-section through an imaging medium of the present invention. The thicknesses of the various layers shown in the drawing are not to scale.

The imaging medium (generally designated 10) shown in the drawing is intended for use in the production of transparencies and comprises a substantially transparent support 12 formed of 4 mil (101 μm) poly(ethylene terephthalate) (PET) film incorporating an ultra-violet absorber. Appropriate PET films are readily available commercially, for example as P4C1A film from DuPont de Nemours., Wilmington, Del.

The imaging medium 10 also comprises a diffusion-reducing subcoat 14 approximately 1 μm thick formed from a 10:1 w/w mixture of a water-dispersible styrene acrylic polymer (Joncryl 538 sold by S. C. Johnson & Son, Inc., Racine, Wis. 53403) and a water-soluble acrylic polymer (Carboset 526 sold by The B. F. Goodrich Co., Akron, Ohio 44313). The presence of the minor proportion of water-soluble acrylic polymer reduces the tendency for the layer 14 to crack during the coating process. The diffusion-reducing subcoat 14, which has a glass transition temperature of approximately 55° C., serves the function of a conventional subcoat, namely increasing the adhesion of the imaging layer 16 (described in detail below) to the support 12. The subcoat 14 also serves to reduce or eliminate migration of dye compound from the imaging layer 16 after imaging; if a conventional subcoat were employed in place of the diffusion-reducing subcoat 14, diffusion of the dye compound from the layer 16 into the subcoat after imaging might cause loss of sharpness of the image. The subcoat 14 is coated onto the support 12 from an aqueous medium containing the water-dispersible and water-soluble polymers.

A yellow imaging layer 16 is in contact with the diffusion-reducing subcoat 14. This imaging layer 16 is approximately 5 μm thick and comprises approximately 47.5 parts by weight of a leuco dye of the formula:

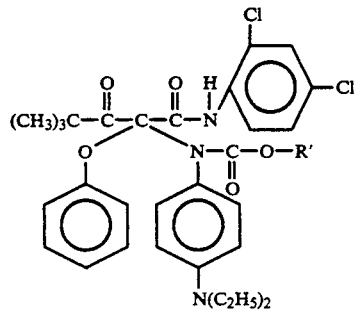

(LD1)

in which R' is a tertiary butyl group (the compounds in which R' is an isobutyl or benzyl group may alternatively be used), 1.6 parts by weight of an infra-red dye of the formula:

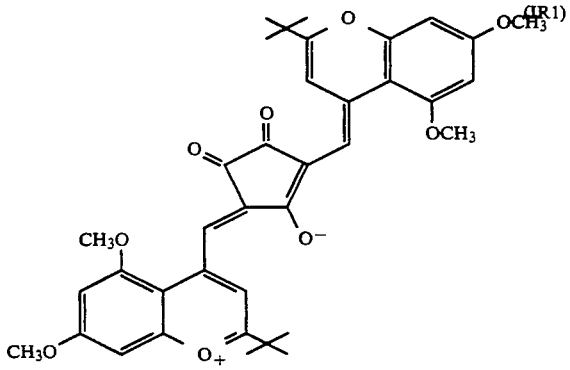

(IR1)

(prepared as described in the aforementioned copending application U.S. Ser. No. 07/795,038; essentially, this dye is produced by condensing two moles of a 2-(1,1-dimethylethyl)-5,7-dimethoxy-4-methylbenzpyrylium salt with a croconate salt), 3.3 parts by weight of a hindered amine stabilizer (HALS-63, sold by Fairmount Chemical Co.), and 47.5 parts by weight of a poly(methyl methacrylate) binder (Elvacite 2021, sold by DuPont de Nemours, Wilmington, Delaware; this material is stated by the manufacturer to be a methyl methacrylate/ethyl acrylate copolymer, but its glass transition temperature approximates that of poly(methyl methacrylate)). This binder has a glass transition temperature of approximately 110° C. The imaging layer 16 is applied by coating from a mixture of heptanes and methyl ethyl ketone.

Superposed on the yellow imaging layer 16 is a diffusion-reducing layer 18, which, like the first diffusion-reducing layer 14, serves to prevent migration of dye compound from the yellow imaging layer 16 on storage after imaging. The diffusion-reducing layer 18, which is approximately 2 μm thick, is formed of a water-dispersible styrene acrylic polymer (Joncryl 138 sold by S. C. Johnson & Son, Inc., Racine, Wis. 53403), and is coated from an aqueous dispersion. This layer has a glass transition temperature of approximately 60° C.

The next layer of the imaging medium 10 is a solvent-resistant interlayer 20 approximately 4.6 μm thick and composed of a major proportion of partially cross-linked polyurethane (NeoRez XR-9637 polyurethane sold by ICI Resins US, Wilmington, Mass.) and a minor proportion of poly(vinyl alcohol) (Airvol 540, sold by Air Products and Chemicals, Inc., Allentown, Pa. 18195). This solvent-resistant interlayer 20 is coated from an aqueous dispersion. The interlayer 20 not only helps to thermally insulate the imaging layers 14 and 22 (described below) from one another during imaging, but also prevents disruption and/or damage to the yellow imaging layer 16 and the diffusion-reducing layer 18 during coating of the magenta imaging layer 22. Since the yellow imaging layer 16 and the magenta imaging layer 22 are both coated from organic solution, if a solvent-resistant interlayer were not provided on the layer 16 before the layer 22 was coated, the organic solvent used to coat the layer 22 might disrupt, damage or extract leuco dye or infra-red absorber from the layer 16. Provision of the solvent-resistant interlayer 20, which is not dissolved by and does not swell in the organic solvent used to coat the layer 22, serves to prevent disruption of or damage to the layer 16 as the layer 22 is coated. Furthermore, the solvent-resistant interlayer 20 serves to prevent the magenta leuco dye, infra-red dye and hindered amine light stabilizer from the layer 22 sinking into the diffusion-reducing layer 18 and the yellow imaging layer 16 as the layer 22 is being coated.

Superposed on the solvent-resistant interlayer 20 is the magenta imaging layer 22, which is approximately 3 μm thick and comprises approximately 47.25 parts by weight of a leuco dye of Formula III above (this leuco dye may be prepared by the methods described in the aforementioned U.S. Pat. Nos. 4,720,449 and 4,960,901), approximately 3.4 parts by weight of zinc acetate (thus giving a leuco dye: zinc cation molar ratio of about 1:0.4), 1.62 parts by weight of an infra-red dye of the formula:

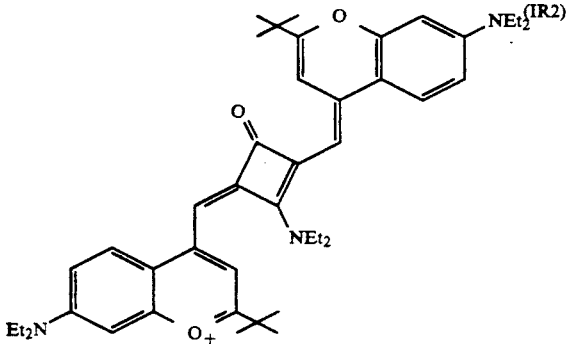

(IR2)

(which may be prepared by the process described in the aforementioned application U.S. Ser. No. 07/795,034; essentially, this dye is produced by reacting a compound of the formula:

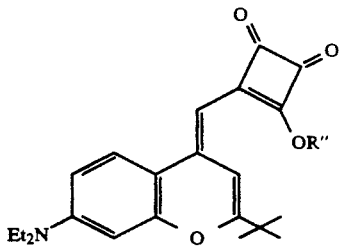

(V)

in which R is a halogen atom or an alkyl group, with diethylamine to introduce the —$NEt_2$ group on the squarylium ring, and then reacting the product with the 4-methylbenzpyrylium salt to give the final infra-red dye of Formula IR2), 3.6 parts by weight of a hindered amine stabilizer (HALS-63), 0.27 parts by weight of a wetting agent, and 47.25 parts by weight of a polyurethane binder (Estane 5715, supplied by The B. F. Goodrich Co., Akron, Ohio 44313). The imaging layer 22 is applied by coating from a cyclohexanone/methyl ethyl ketone mixture.

(Alternatively, the infra-red dye of Formula IR2 above may be replaced by the dye of formula:

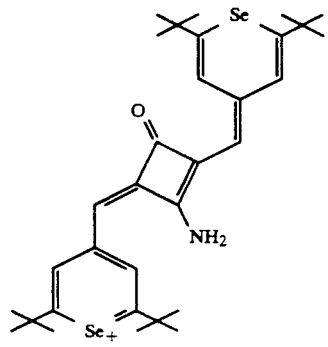

(IR3)

Figure 4:
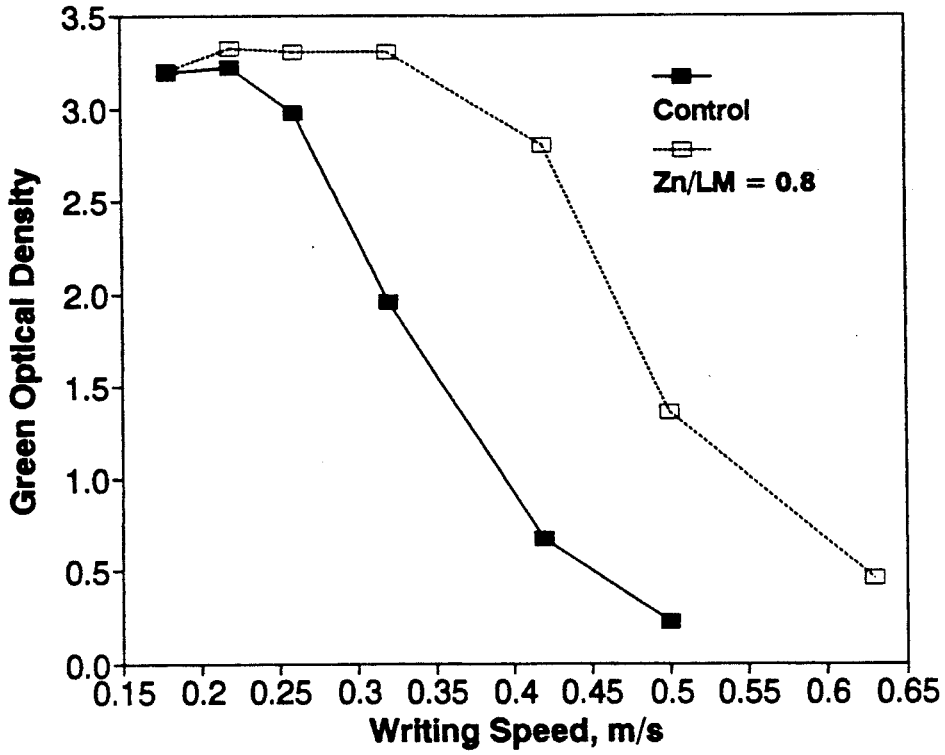
FIG. 4 shows the effect of zinc cation in increasing the sensitivity of a thermal imaging medium containing a magenta color-forming compound, as described in Example 2 below.

(used in the form of its tetrafluoroborate salt) (this infra-red dye may be prepared by the process analogous to that used to prepare the infra-red dye of Formula IR2 above using the corresponding selenopyrylium squaric acid derivative and ammonia to introduce the amino group, followed by condensation of the product with a selenopyrylium salt; to prepare the selenopyrylium squaric acid derivative, the corresponding selenopyrylium salt is substituted for the benzpyrylium salt IV in the reactions shown in FIG. 4).)

On the imaging layer 22 is coated a second solvent-resistant interlayer 24 which is formed from the same material, and coated in the same manner as, the solvent-resistant interlayer 20.

Superposed on the second solvent-resistant interlayer 24 is a cyan imaging layer 26, which is approximately 3 μm thick and comprises approximately 49.5 parts by weight of a leuco dye of Formula IV above (this leuco dye may be prepared by the methods described in the aforementioned U.S. Pat. Nos. 4,720,449 and 4,960,901), approximately 3.97 grams of zinc acetate (thus giving a leuco dye: zinc cation molar ratio of about 1:0.4), 1.62 parts by weight of an infra-red dye of the formula:

(IR4)

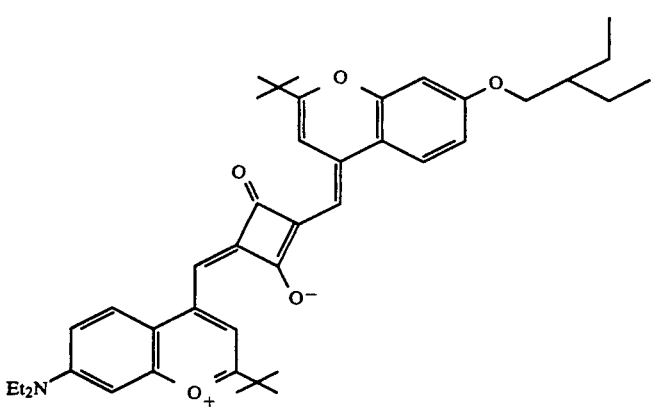

(which is preferably prepared by the process described in the aforementioned copending application U.S. Ser. No. 07/696,222; essentially this process comprises reacting a diester, diacid chloride or monoester monoacid chloride of squaric acid with a 2-(1,1-dimethylethyl)7-diethylamino-4-methylbenzpyrylium salt and hydrolysing to produce a benzpyryliummethylidene compound, and then reacting this compound with a 7-alkoxy-2-(1,1-dimethylethyl)-4-methylbenzpyrylium salt to give the final infra-red dye), 0.2 parts of a wetting agent, and 49.5 parts by weight of a polyurethane binder (Estane 5715). The imaging layer 26 is applied by coating from methyl ethyl ketone.

(Alternatively, the infra-red dye of Formula IR4 above may be replaced by the dye of formula:

(IR5)

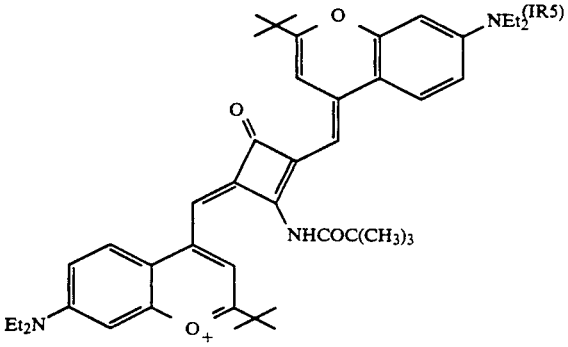

(which may be prepared by a process analogous to that used to prepare the infra-red dye of Formula IR2 above, by reacting the intermediate of Formula V above with ammonia to introduce an amino group on the squarylium ring, then reacting the product with a 4-methylbenzpyrylium salt to produce the amino squarylium dye, and finally reacting this amino squarylium dye with pivaloyl chloride to produce the final pivaloylamino group on the squarylium ring).

As already indicated, the layers 14–26 of the imaging medium 10 are produced by coating on to the transparent support 12. However, the remaining layers of the imaging medium 10, namely the transparent bubble-suppressant layer 32, the ultraviolet filter layer 30 and the adhesive layer 28 are not coated on to the layer 26 but rather are prepared as a separate unit and then laminated to the remaining layers of the medium.

The transparent bubble-suppressant layer 32 is a 1.75 mil (44 μm) PET film, a preferred film being that sold as ICI 505 film by ICI Americas, Inc., Wilmington, Del. The bubble-suppressant layer 32 prevents the formation of bubbles in the imaging layers 16, 22 and 26 of the imaging medium 10 during imaging.

The ultraviolet filter layer 30 serves to protect the imaging layers 16, 22 and 26 from the effects of ambient ultraviolet radiation. It has been found that the leuco dyes are susceptible to undergoing color changes when exposed to ultraviolet radiation during storage before or after imaging; such color changes are obviously undesirable since they increase the $D_{min}$ of the image and may distort the colors therein. The ultraviolet filter layer 30 is approximately 5 μm thick and comprises approximately 83 percent by weight of a poly(methyl methacrylate) (Elvacite 2043, sold by DuPont de Nemours, Wilmington, Mass.), 16.6 percent by weight of an ultraviolet filter (Tinuvin 328 sold by Ciba-Geigy, Ardsdale, N.Y.) and 0.4 percent by weight of a wetting agent. The ultraviolet filter layer 30 is prepared by coating on to the bubble-suppressant layer 32 from a solution in methyl ethyl ketone.

The adhesive layer, which is approximately 2 μm thick, is formed of a water-dispersible styrene acrylic polymer (Joncryl 138 sold by S. C. Johnson & Son, Inc., Racine, Wis. 53403) and is coated on to the ultraviolet filter layer 30 from an aqueous dispersion.

After the layers 30 and 28 have been coated on to the bubble-suppressant layer 32, the entire structure containing these three layers is laminated under heat (approximately 225° F., 107° C.) and pressure to the structure containing the layers 12–26 to form the complete imaging medium 10.

If desired, the bubble-suppressant layer 32 may be formed by coating, rather than by lamination of a preformed film on to the layers 12–26. If the bubble-suppressant layer 32 is to be formed by coating, it is convenient to incorporate an ultra-violet absorber into the bubble-suppressant layer, thereby avoiding the need for a separate ultra-violet absorber layer. Thus, in this case, the layer 28 is coated on to the layer 26 using the solvent already described, and then the bubble-suppressant layer 32 containing the ultra-violet absorber may be coated on to the layer 28 from an aqueous medium.

The medium 10 is imaged by exposing it to the beams from three infra-red lasers having wavelengths of approximately 792, 848 and 926 nm. The 926 nm beam images the yellow imaging layer 16, the 848 nm beam images the magenta imaging layer 22 and the 792 nm beam images the cyan imaging layer 26. Thus, a multicolor image is formed in the imaging medium 10, and this multicolor image requires no further development steps. Furthermore, the medium 10 may be handled in normal room lighting prior to exposure, and the apparatus in which the imaging is performed need not be light-tight.

The following Examples are given, though by way of illustration only, to show the effects of metal cations in increasing the sensitivity of the imaging medium of the present invention, and in reducing projector fading in images produced therefrom. The infra-red dyes used in combination with the leuco dyes of these Examples were different from those used in the preferred imaging medium described above with reference to FIG. 1, and were as follows:

With yellow leuco dyes:

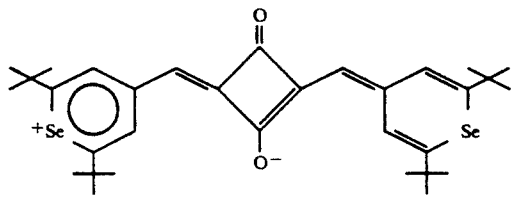

which may be prepared by a process analogous to that described in U.S. Pat. No. 4,508,811 using the 2,6-bis(1,1-dimethylethyl)-4-methylselenopyrylium salts described in the aforementioned application U.S. Ser. No. 07/696,222;

With magenta leuco dyes:

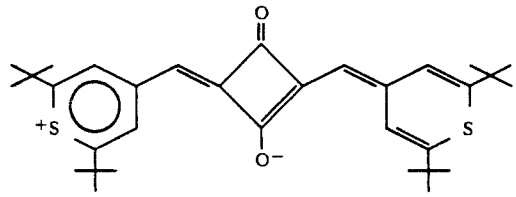

see U.S. Pat. No. 4,508,811; and

With cyan leuco dyes:

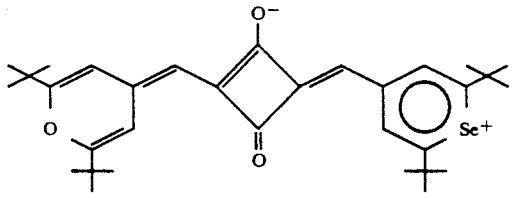

which may be prepared as described in the aforementioned copending application U.S. Ser. No. 07/696,222.

EXAMPLE 1

This Example illustrates the effect of zinc cation in increasing sensitivity of, and reducing projector fading of images formed from, imaging media containing the cyan leuco dye of Formula IV above.

PART A: SENSITIVITY EXPERIMENTS

The following experiments used a simplified, monochrome model of the imaging medium described above with reference to FIG. 1. This simplified model comprised the support 12 incorporating an ultra-violet absorber, the cyan imaging layer 26 (with varying amounts of zinc acetate, as described below, and with the aforementioned Elvacite 2021 poly(methyl methacrylate) replacing the Estane 5715 used in the medium shown in FIG. 1), an adhesive layer 28 and a bubble-suppressant layer 32, which was formed from the same polymeric film as the support 12 and thus incorporated an ultra-violet absorber.

Three imaging media were prepared, a control in which the imaging layer contained no zinc acetate, and two others in which the molar ratio of leuco dye to zinc acetate was 1:0.19 and 1:0.38 (hereinafter referred to as "Zn/LC=0.19" and "Zn/LC=0.38" respectively). All three media were then imaged with a 792 nm laser at varying writing speeds (the speed at which the focussed spot from the laser is moved across the medium), a separate area of the medium being imaged at each writing speed, to produce images having regions of varying red optical densities. The red optical densities of the various areas of the resultant images were measured using an X-Rite 310 photographic densitometer (supplied by X-Rite, Inc., Grandville, Mich.) with the appropriate filter. The results are shown in Table 1 below and plotted in FIG. 2 of the accompanying drawings, in which the red optical density achieved is plotted against writing speed.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table 1 below and plotted in FIG. 3 of the accompanying drawings, in which the percentage change in red optical density of the images is plotted against the optical density is calculated by:

$$\% \text{ Change in O.D.} = 100(D_a - D_b)/D_b$$

where $D_a$ is the optical density after projector exposure and $D_b$ is the optical density before exposure. Obviously, negative percentage changes in optical density represent fading of the image.

TABLE 1

| Optical Density at 792 nm | Control 0.91 | | Zn/LC = 0.19 0.81 | | Zn/LC = 0.38 0.92 | |
|---|---|---|---|---|---|---|
| Writing Speed, m/s | Initial Red Density | Change in O.D., % | Initial Red Density | Change in O.D., % | Initial Red Density | Change in O.D., % |
| 0.18 | 2.85 | −8.1 | 4.25 | −7.8 | 4.09 | −2.9 |
| 0.22 | 2.48 | −7.7 | 4.14 | −1.7 | 4.15 | −3.2 |
| 0.26 | 1.87 | −16.0 | 3.37 | 0.6 | 3.91 | −4.1 |
| 0.32 | 0.99 | −22.0 | 1.96 | −8.7 | 2.61 | −5.6 |

TABLE 1-continued

| Optical Density at 792 nm | Control 0.91 | | Zn/LC = 0.19 0.81 | | Zn/LC = 0.38 0.92 | |
|---|---|---|---|---|---|---|
| Writing Speed, m/s | Initial Red Density | Change in O.D., % | Initial Red Density | Change in O.D., % | Initial Red Density | Change in O.D., % |
| 0.42 | 0.30 | −15.6 | 0.48 | 4.2 | 0.77 | −2.9 |
| 0.50 | 0.12 | −8.5 | 0.28 | −14.3 | 0.30 | −3.3 |
| 0.63 | | | 0.11 | 3.6 | 0.12 | −8.3 |

Figure 2:
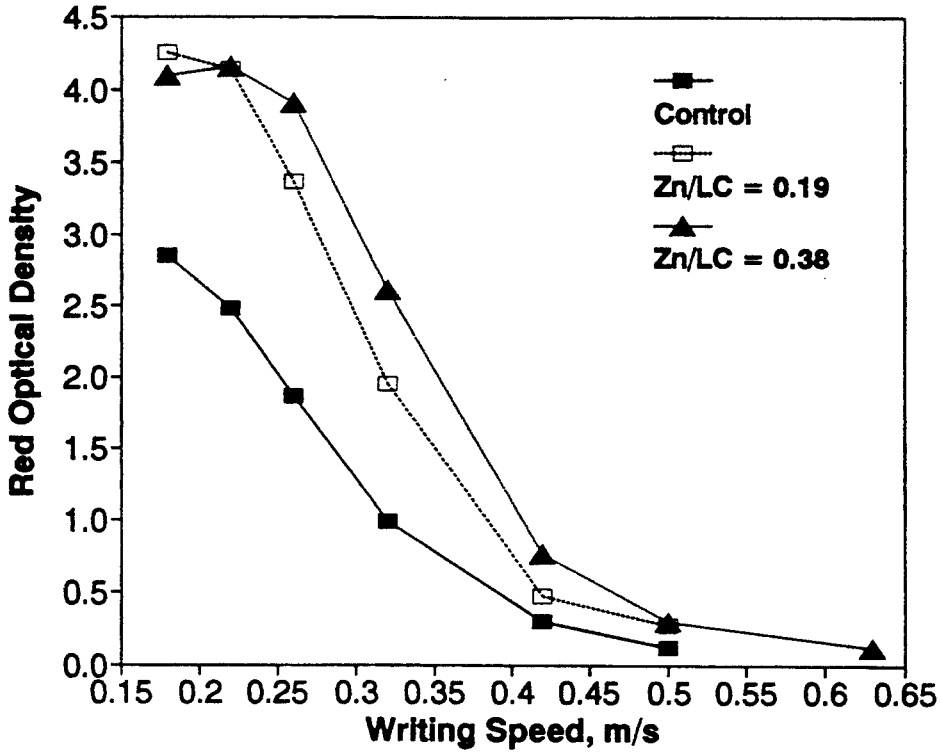
FIG. 2 shows the effect of zinc cation in increasing the sensitivity of a thermal imaging medium containing a cyan color-forming compound, as described in Example 1 below.

From Table 1 and FIG. 2 it will be seen that both zinc-containing media produced optical densities at a given writing speed higher than that produced by the zinc-free control medium, with the medium having a leuco dye:zinc ratio of 1:0.38 giving a higher optical density at a given writing speed than the medium having a leuco dye:zinc ratio of 1:0.19. Thus, the addition of zinc to the cyan imaging layer rendered the medium more sensitive, with the sensitivity increasing with the zinc content.

Quantifying the increase in sensitivity produced by a given metal additive is complicated by a "burn-out" phenomenon which is just visible in FIG. 2 but which is more easily discerned in other experiments described below; see, for example, FIG. 12. Although this "burn-out" phenomenon is not described in the aforementioned patents, it is known that if a thermal imaging medium having a color-forming layer such as those used in the present invention is imaged at progressively greater exposures (i.e., greater energy inputs per unit area of medium), the optical density of the image increases steadily with exposure until a point of maximum optical density is reached, after which further increase in exposure results in the optical density decreasing with exposure, so that very heavily exposed samples of medium have optical densities significantly less than the maximum achievable for that medium. It is this decrease in optical density with increasing exposure which is referred to as "burn-out". In experiments such as those whose results are shown in FIG. 2, in which a laser of constant energy output is used and the writing speed is varied, burn-out is manifested as a positive slope of the optical density against writing speed curve at low writing speeds, since exposure is inversely proportional to writing speed.

As might be expected, the experiments described herein show that media sensitized with metal cations in accordance with the present invention begin to manifest burn-out at lower exposures (and thus higher writing speeds) than similar unsensitized media. Accordingly, at low writing speeds a sensitized medium might produce a lower optical density than the corresponding unsensitized medium because at that low writing speed the sensitized medium is already suffering from severe burn-out, while the unsensitized medium has not begun to suffer from burn-out. Thus, the sensitivities of various media can only properly be compared at exposures and writing speeds where none of the media being compared are suffering from burn-out; in other words, when making sensitivity comparisons, the comparisons must be made in regions of optical density/writing speed curves where all the relevant curves have a significant negative slope. Hereinafter, quoted percentage increases in sensitivity are expressed as:

[{Average of (Optical Density of Sensitized Medium/Optical Density of Unsensitized Medium)} − 1] ×

-continued

100% with the relevant range of writing speeds indicated in parentheses following the percentage.

Using this formula, the Zn/LC=0.19 medium showed a 93% (writing speeds 0.26−0.5 m/s) increase in sensitivity, and the Zn/LC=0.38 medium showed a 145% (writing speeds 0.26−0.5 m/s) increase in sensitivity.

Figure 3:
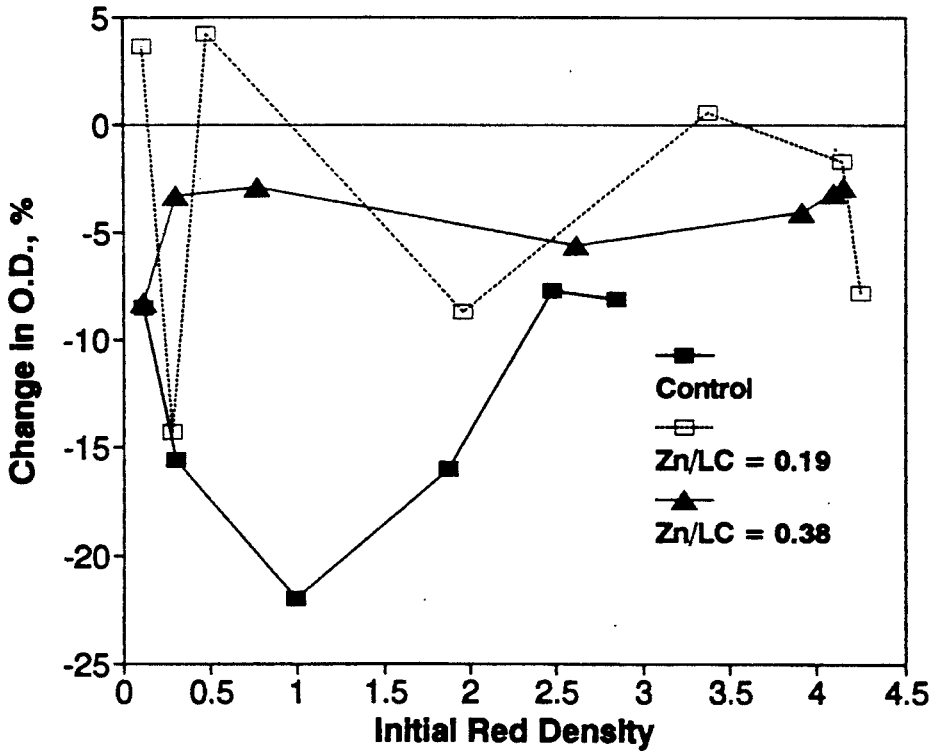
FIG. 3 shows the effect of zinc cation in preventing fading of images produced from a cyan color-forming compound, as described in Example 1 below.

Also, from Table 1 and FIG. 3 it will be seen that the addition of 0.19 mole of zinc per mole of cyan leuco dye greatly reduced the fading experienced in the control medium after 10 minutes of projector exposure, while the addition of 0.38 mole of zinc per mole of cyan leuco dye substantially eliminated this fading.

EXAMPLE 2

This Example illustrates the effect of zinc cation in increasing sensitivity of, and reducing projector fading of images formed from, imaging media containing the magenta leuco dye of Formula III above.

PART A: SENSITIVITY EXPERIMENTS

The media used in this experiment were the same as in Example 1 above, except that the cyan imaging layer 26 was replaced with the magenta imaging layer 22 described above with reference to FIG. 1, with the aforementioned Elvacite 2021 poly(methyl methacrylate) replacing the Estane 5715 used in the medium shown in FIG. 1. Two media were prepared, a control in which the magenta imaging layer contained no zinc acetate, and one in which the molar ratio of leuco dye to zinc acetate was 1:0.8 (hereinafter referred to as "Zn/LM=0.8"). These two media were imaged and their optical densities recorded in the same way as in Example 1, except that an 822 nm laser was used and that the green optical densities were measured for the magenta image. The results are shown in Table 2 below and FIG. 4 of the accompanying drawings.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 20 minutes with the projector on the high setting, and the green optical densities of the various areas of the images remeasured following projector exposure in the same manner as before. The results are shown in Table 2 below and plotted in FIG. 5 of the accompanying drawings, in which the percentage change in optical density of the images is plotted against the initial green optical density.

TABLE 2

| Writing Speed, m/s | Control Initial Green Density | Control Change in O.D., % | Zn/LM = 0.8 Initial Green Density | Zn/LM = 0.8 Change in O.D., % |
|---|---|---|---|---|
| 0.18 | 3.19 | −2.5 | 3.20 | 2.0 |
| 0.22 | 3.22 | −3.7 | 3.32 | −2.1 |
| 0.26 | 2.98 | −7.0 | 3.30 | −1.5 |
| 0.32 | 1.96 | −9.2 | 3.30 | −1.5 |
| 0.42 | 0.67 | −12.0 | 2.80 | −5.0 |
| 0.50 | 0.22 | −18.0 | 1.36 | −2.9 |
| 0.63 | | | 0.46 | −4.4 |
| 0.75 | | | 0.19 | −5.3 |

From Table 2 and FIG. 4 it will be seen that the zinc-containing medium produced a higher optical density at a given writing speed than that produced by the zinc-free control medium. The Zn/LC=0.8 medium showed a 301% (writing speeds 0.32−0.5 m/s) increase in sensitivity. Thus, the addition of zinc to the magenta imaging layer rendered the medium more sensitive.

Figure 5:
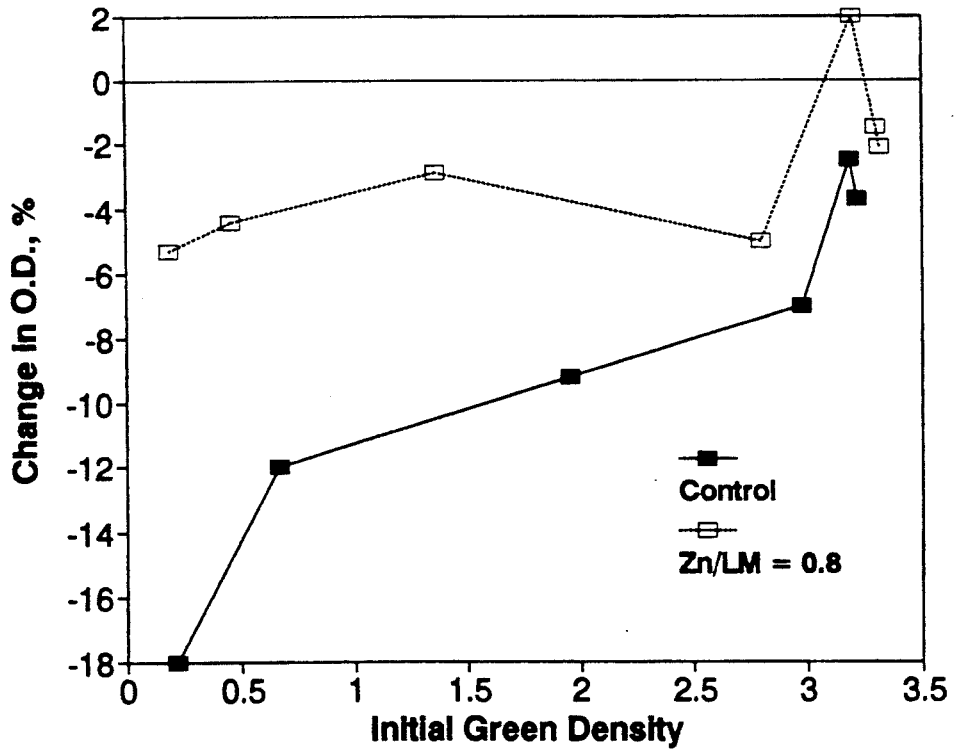
FIG. 5 shows the effect of zinc cation in preventing fading of images produced from a magenta color-forming compound, as described in Example 2 below.

Also, from Table 2 and FIG. 5 it will be seen that the addition of 0.8 mole of zinc per mole of magenta leuco dye substantially eliminated the fading experienced in the control medium after 20 minutes of projector exposure.

EXAMPLE 3

This Example illustrates the effect of zinc cation in increasing sensitivity of imaging media containing a relatively insensitive yellow leuco dye of the formula:

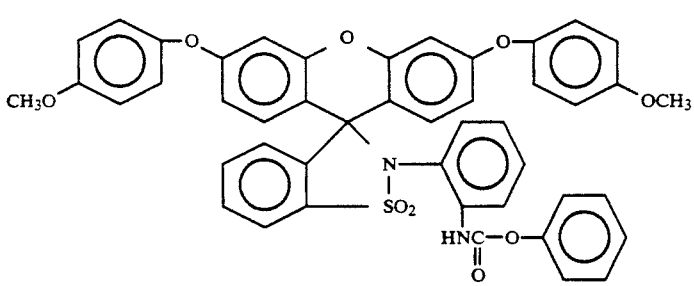

(VI)

The media used in this experiment were the same as in Example 1 above, except that the cyan imaging layer 26 was replaced with an imaging layer similar to the yellow imaging layer 16 described above with reference to FIG. 1 but containing the above yellow leuco dye. Two media were prepared, a control in which the yellow imaging layer contained no zinc acetate, and one in which the molar ratio of leuco dye to zinc acetate was 1:0.29. These two media were imaged and their optical densities recorded in the same way as in Example 1, except that an 869 nm laser was used and that the blue optical densities were measured for the yellow image. The results are shown in Table 3 below and FIG. 6 of the accompanying drawings.

TABLE 3

| Writing Speed, m/s | Control Blue Optical Density | Zn/LY = 0.29 Blue Optical Density |
|---|---|---|
| 0.125 | 0.20 | 1.01 |
| 0.14 | 0.19 | 0.90 |
| 0.16 | 0.16 | 0.86 |
| 0.18 | 0.14 | 0.81 |
| 0.22 | 0.11 | 0.70 |
| 0.26 | 0.08 | 0.48 |
| 0.32 | | 0.22 |

Figure 6:
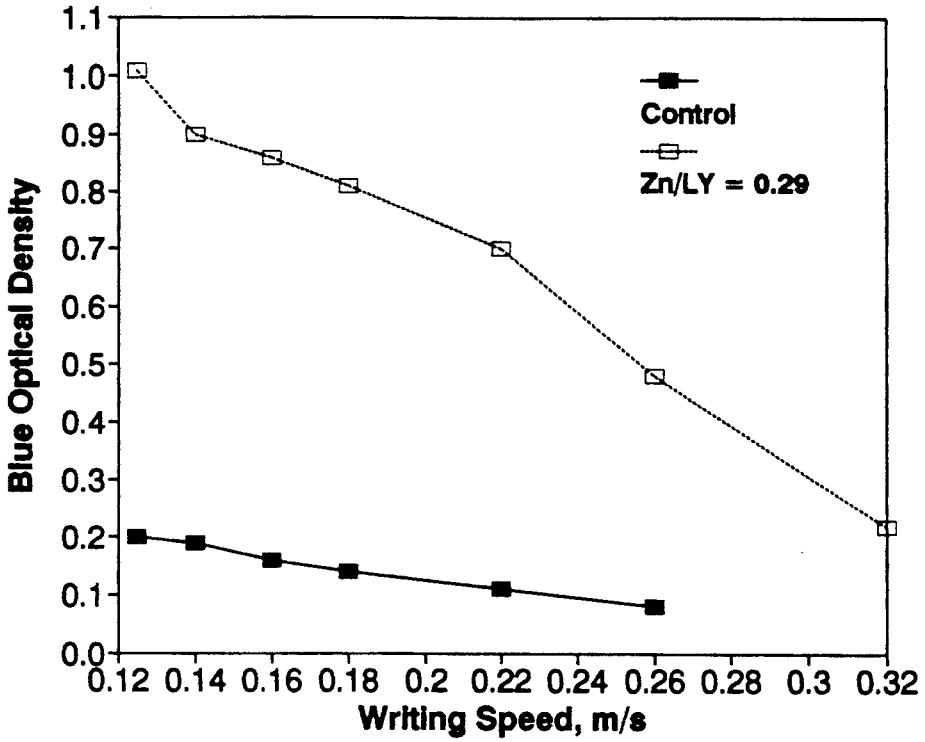
FIG. 6 shows the effect of zinc cation in increasing the sensitivity of a medium containing a relatively insensitive yellow color-forming compound, as described in Example 3 below.

From Table 3 and FIG. 6 it will be seen that the zinc-containing medium produced a much higher optical density at a given writing speed than that produced by the zinc-free control medium; in fact the Zn/LY=0.29 medium showed a 455% (writing speeds 0.125−0.26 m/s) increase in sensitivity. Thus, the addition of zinc to the yellow imaging layer rendered the medium much more sensitive, especially at the lower writing speeds.

It should be noted that no substantial increase in sensitivity was observed in the imaging of similar media containing the yellow leuco dye of Formula V above, which does not contain a sulfonamide ring.

EXAMPLE 4

This Example illustrates the effect of zinc and nickel cations in reducing projector fading of images formed from imaging media containing the cyan leuco dye of Formula IV above.

The media used in these experiments were similar to those used in Example 1 above and the color-forming layer of each medium had a leuco dye: Elvacite 2021 weight ratio of 1:1. The media comprised a control medium in which the color-forming layer contained no metal cations, a second medium in which the color-forming layer contained zinc acetate at a leuco dye:zinc molar ratio of 1:0.3 and a third medium in which the color-forming layer contained nickel acetate at a leuco dye:nickel molar ratio of 1:0.3. The three media were imaged in the same way as in Example 1 above but using a 785 nm laser, their red optical densities measured, placed in a projector for 10 minutes and their optical densities remeasured, all in the same way as in Example 1. The results are shown in Table 4 below and plotted in FIG. 7 of the accompanying drawings, in which the percentage change in optical density of the images is plotted against the initial red optical density.

TABLE 4

| Optical Density at 785 nm | Control 0.99 | | Zn/LC = 0.3 1.25 | | Ni/LC = 0.3 0.88 | |
|---|---|---|---|---|---|---|
| | Initial Red Density | Change in O.D., % | Initial Red Density | Change in O.D., % | Initial Red Density | Change in O.D., % |
| | 2.08 | −9.3 | 2.96 | −5.7 | 2.79 | −3.0 |
| | 1.80 | −11.1 | 2.81 | −12.2 | 2.38 | −3.4 |
| | 1.40 | −30.0 | 2.06 | −2.9 | 1.66 | −6.0 |
| | 1.15 | −14.8 | 1.58 | −14.5 | 0.88 | −5.7 |
| | 0.70 | −14.3 | 0.83 | −15.6 | | |
| | 0.27 | −12.5 | 0.27 | −3.7 | | |

Figure 7:
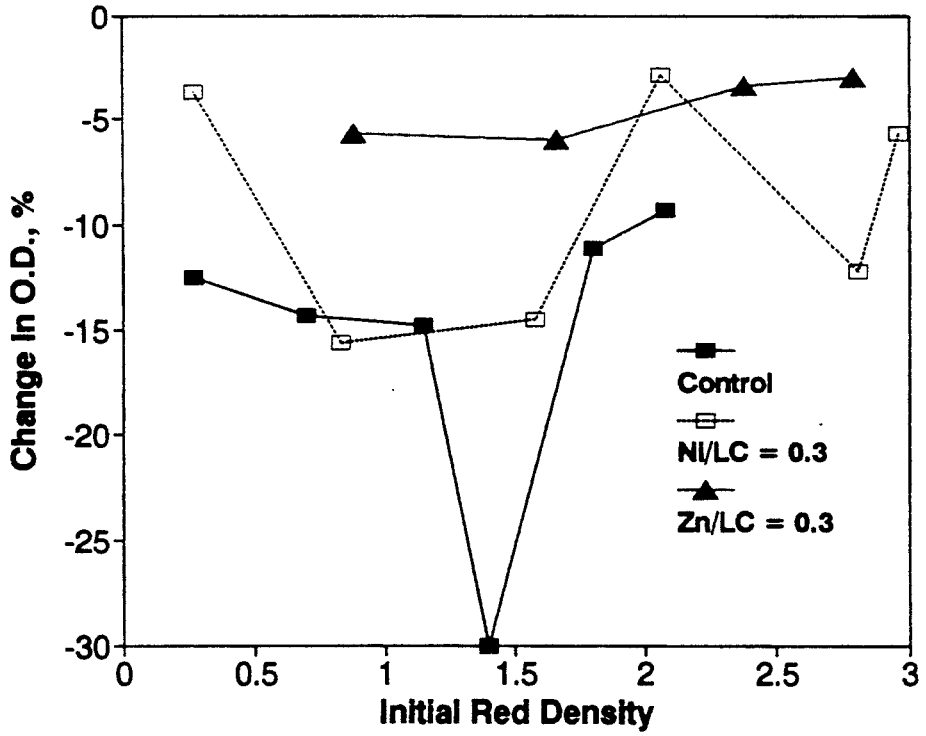
FIG. 7 shows the effect of zinc and nickel cations in preventing fading of images produced from a cyan color-forming compound, as described in Example 4 below.

From Table 4 and FIG. 7, it will be seen that both zinc and nickel cations substantially reduced the fading of the images produced from these imaging media.

EXAMPLE 5

This Example illustrates the effect of zinc, aluminum and nickel cations in increasing sensitivity of, and reducing projector fading of images formed from, imaging media containing the cyan leuco dye of Formula IV above.

PART A: SENSITIVITY EXPERIMENTS

The media used in this experiment were the same as in Example 1 above, except that the color-forming layers contained the Estane 5715 used in the medium shown in FIG. 1, and had a leuco dye: polymer weight ratio of 0.5:1. Four media were prepared, a control in which the cyan color-forming layer contained no metal cations, a second medium in which the color-forming layer contained zinc acetate at a leuco dye:zinc molar ratio of 1:0.36, a third medium in which the color-forming layer contained aluminum acetate at a leuco dye:aluminum molar ratio of 1:0.23, and a fourth medium in which the color-forming layer contained nickel acetate at a leuco dye:nickel molar ratio of 1:0.32. These four media were imaged and their optical densities recorded in the same way as in Example 1. The results are shown in Table 5 below and plotted in FIG. 8 of the accompanying drawings.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table 5 below and plotted in FIG. 9 of the accompanying drawings, in which the percentage change in optical density of the images is plotted against the initial red optical density.

Figure 8:
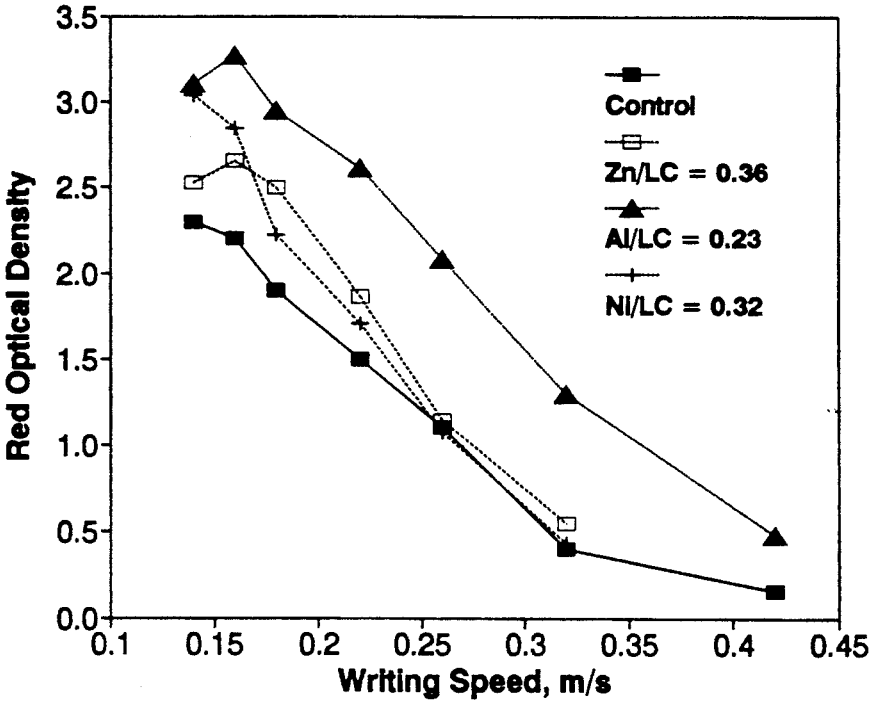
FIG. 8 shows the effect of zinc, nickel and aluminum cations in increasing the sensitivity of a thermal imaging medium containing a cyan color-forming compound, as described in Example 5 below.

From Table 5 and FIG. 8 it will be seen that the metal-containing media produced higher optical densities at certain writing speeds than that produced by the metal-free control medium; in fact, the Zn/LC=0.36 medium showed a 24% (writing speeds 0.16−0.32 m/s) increase in sensitivity, the Al/LC=0.23 medium showed a 98% (writing speeds 0.16−0.32 m/s) increase in sensitivity, and the Ni/LC=0.32 medium showed a 13% (writing speeds 0.16−0.32 m/s) increase in sensitivity. Thus, the addition of these metals to the cyan imaging layer rendered the medium more sensitive.

Figure 9:
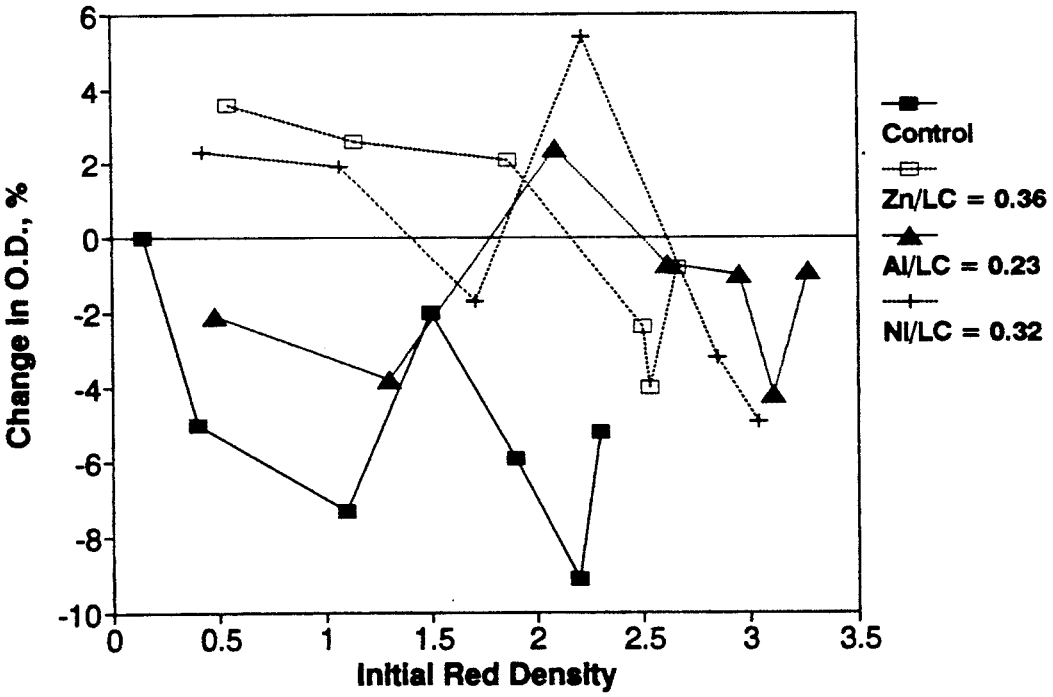
FIG. 9 shows the effect of zinc, nickel and aluminum cations in preventing fading of images produced from a cyan color-forming compound, as described in Example 5 below.

Also, from Table 5 and FIG. 9 it will be seen that the addition of the metals substantially reduced the fading experienced in the control medium after 10 minutes of projector exposure.

EXAMPLE 6

This Example illustrates the effect of zinc cation in increasing sensitivity of, and reducing projector fading of images formed from, imaging media containing the cyan leuco dye of Formula IV above.

PART A: SENSITIVITY EXPERIMENTS

The media used in this experiment were full-color media generally similar to that described above with reference to FIG. 1, but with the following modifications:

(a) the transparent support 12 was a 4 mil (101 μm) poly(ethylene terephthalate) anti-static film with a gelatin sub-coat (P4C1AX2 film available from DuPont de Nemours, Wilmington, Del.);

(b) in the magenta imaging layer 22, the Estane 5715 binder was replaced by Estane 5706, a polyurethane from the same manufacturer; Estane 5706 has a substantially higher glass transition temperature than Estane 5715; and (c) in the cyan imaging layer 26, the Estane 5715 binder was replaced by Elvacite 2041, a poly(methyl methacrylate) available from DuPont de Nemours, Wilmington, Del.; Elvacite 2041 has a substantially higher glass transition temperature than Estane 5715.

TABLE 5

| Optical Density at 792 nm | Control 1.03 | | Zn/LC = 0.36 0.88 | | Al/LC = 0.23 1.01 | | Ni/LC = 0.32 0.97 | |
|---|---|---|---|---|---|---|---|---|
| Writing Speed, m/s | Initial Red Density | Change in O.D., % | Initial Red Density | Change in O.D., % | Initial Red Density | Change in O.D., % | Initial Red Density | Change in O.D., % |
| 0.14 | 2.3 | −5.2 | 2.53 | −4.0 | 3.11 | −4.2 | 3.04 | −4.9 |
| 0.16 | 2.2 | −9.1 | 2.66 | −0.8 | 3.27 | −0.9 | 2.85 | −3.2 |
| 0.18 | 1.9 | −5.9 | 2.5 | −2.4 | 2.95 | −1.0 | 2.22 | 5.4 |
| 0.22 | 1.5 | −2.0 | 1.87 | 2.1 | 2.62 | −0.7 | 1.71 | −1.7 |
| 0.26 | 1.1 | −7.3 | 1.14 | 2.6 | 2.09 | 2.4 | 1.07 | 1.9 |
| 0.32 | 0.4 | −5.0 | 0.55 | 3.6 | 1.3 | −3.8 | 0.43 | 2.3 |
| 0.42 | 0.15 | 0.0 | | | 0.48 | −2.1 | | |

Two media were prepared, a control in which the cyan imaging layer contained no zinc acetate, and one in which the molar ratio of leuco dye to zinc acetate was 1:0.3. These two media were imaged and their optical densities recorded in the same way as in Example 1. The results are shown in Table 6 below and FIG. 10 of the accompanying drawings.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 20 minutes with the projector on the high setting, and the red optical densities of the various areas of the images remeasured following projector exposure in the same manner as before. The results are shown in Table 6 below and plotted in FIG. 10 of the accompanying drawings, in which the percentage change in optical density of the images is plotted against the initial red optical density.

TABLE 6

| Writing Speed, m/s | Control Initial Red Density | Control Change in O.D., % | Zn/LM = 0.8 Initial Red Density | Zn/LM = 0.8 Change in O.D., % |
|---|---|---|---|---|
| 0.18 | 3.71 | −10.8 | 4.03 | 1.0 |
| 0.22 | 2.53 | −17.8 | 3.96 | −2.5 |
| 0.26 | 1.39 | −23.7 | 3.23 | −5.6 |
| 0.32 | 0.53 | −18.9 | 1.43 | −7.7 |
| 0.42 | 0.15 | −20.0 | 0.49 | −8.2 |
| 0.51 | | | 0.21 | −10.5 |

Figure 10:
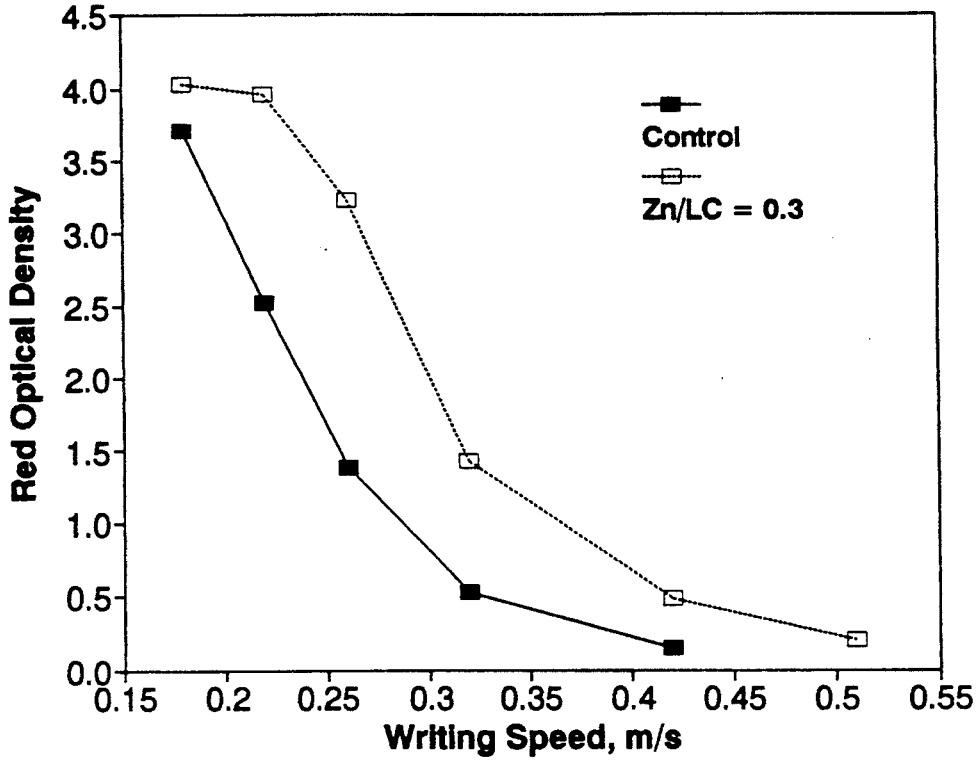
FIG. 10 shows the effect of zinc cation in increasing the sensitivity of a thermal imaging medium containing a cyan color-forming compound, as described in Example 6 below.

From Table 6 and FIG. 10 it will be seen that the zinc-containing medium produced a higher optical density at a given writing speed than that produced by the zinc-free control medium; in fact, the Zn/LC=0.3 medium showed a 146% (writing speeds 0.22–0.42 m/s) increase in sensitivity. Thus, the addition of zinc to the cyan imaging layer rendered the medium more sensitive.

Figure 11:
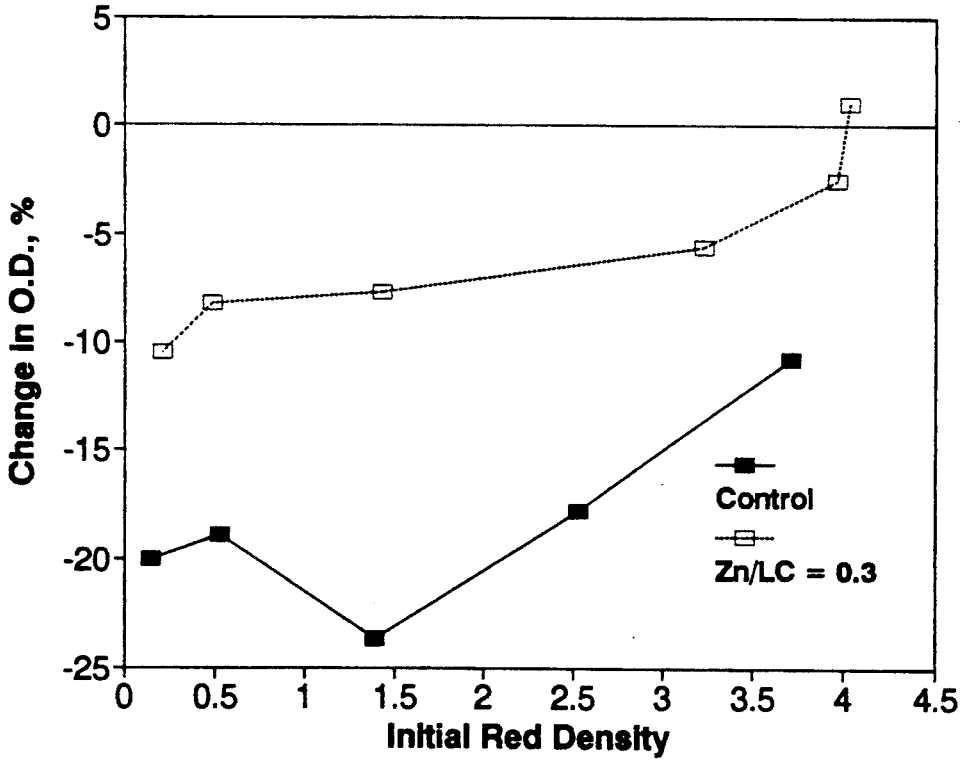
FIG. 11 shows the effect of zinc cation in preventing fading of images produced from a cyan color-forming compound, as described in Example 6 below.

Also, from Table 6 and FIG. 11 it will be seen that the addition of zinc substantially reduced the fading experienced in the control medium after 10 minutes of projector exposure.

EXAMPLE 7

This Example illustrates the effect of zinc isobutyrate in increasing sensitivity of, and reducing projector fading of images formed from, imaging media containing the cyan leuco dye of Formula IV above.

PART A: SENSITIVITY EXPERIMENTS

The media used in this experiment were the same as in Example 1 above. Four media were prepared, a control in which the cyan color-forming layer contained no zinc, and three others in which the color-forming layer contained zinc isobutyrate at leuco dye:zinc molar ratio of 1:0.2, 1:0.4 and 1:0.8. These four media were imaged and their optical densities recorded in the same way as in Example 1, except that a 785 nm laser was used for imaging. The results are shown in Table 7 below and plotted in FIG. 12 of the accompanying drawings.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table 7 below and plotted in FIG. 13 of the accompanying drawings, in which the percentage change in optical density of the images is plotted against the initial red optical density.

TABLE 7

| Optical Density at 785 nm | Control 1.21 | | Zn/LC = 0.2 1.31 | | Zn/LC = 0.4 1.15 | | Zn/LC = 0.8 1.13 | |
|---|---|---|---|---|---|---|---|---|
| Writing Speed, m/s | Initial Red Density | Change in O.D., % | Initial Red Density | Change in O.D., % | Initial Red Density | Change in O.D., % | Initial Red Density | Change in O.D., % |
| 0.14 | 3.11 | −6.4 | 3.18 | −2.2 | 3.61 | −5.8 | 3.36 | −3.0 |
| 0.16 | 3.3 | −6.7 | 3.5 | −4.3 | 3.83 | −5.0 | 3.51 | 0.8 |
| 0.18 | 3.15 | −9.8 | 3.62 | −5.0 | 3.92 | −4.8 | 4.07 | −10.0 |
| 0.22 | 2.63 | −11.8 | 3.39 | −4.4 | 3.58 | −3.9 | 3.99 | −9.8 |
| 0.26 | 1.77 | −14.1 | 2.54 | −6.7 | 2.55 | −0.8 | 3.1 | −3.9 |
| 0.32 | 0.89 | −13.5 | 1.14 | −6.1 | 1.12 | −2.9 | 1.44 | −3.5 |
| 0.42 | 0.39 | −25.6 | 0.33 | −3.0 | 0.34 | −3.9 | 0.42 | −4.8 |

Figure 12:
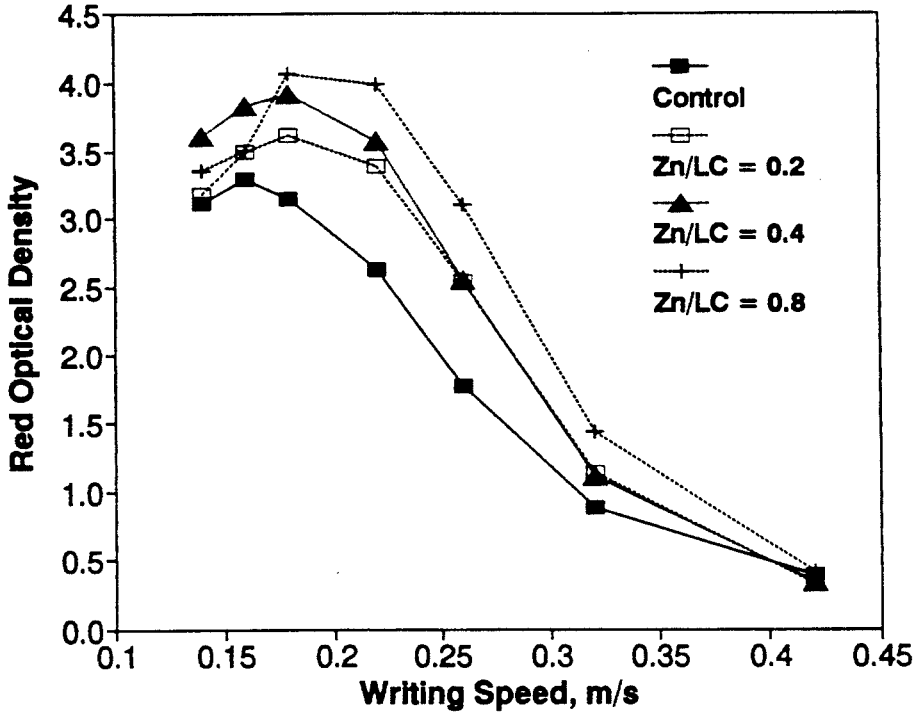
FIG. 12 shows the effect of varying amounts of zinc cation in increasing the sensitivity of a thermal imaging medium containing a cyan color-forming compound, as described in Example 7 below.

From Table 7 and FIG. 12 it will be seen that the zinc-containing media produced higher optical densities at a given writing speeds than that produced by the control medium; in fact, the Zn/LC=0.2 medium showed a 21% (writing speeds 0.22−0.42 m/s) increase in sensitivity, the Zn/LC=0.4 medium showed a 23% (writing speeds 0.22−0.42 m/s) increase in sensitivity, and the Zn/LC=0.8 medium showed a 49% (writing speeds 0.22−0.42 m/s) increase in sensitivity. Thus, the addition of zinc to the cyan imaging layer rendered the medium more sensitive.

Figure 13:
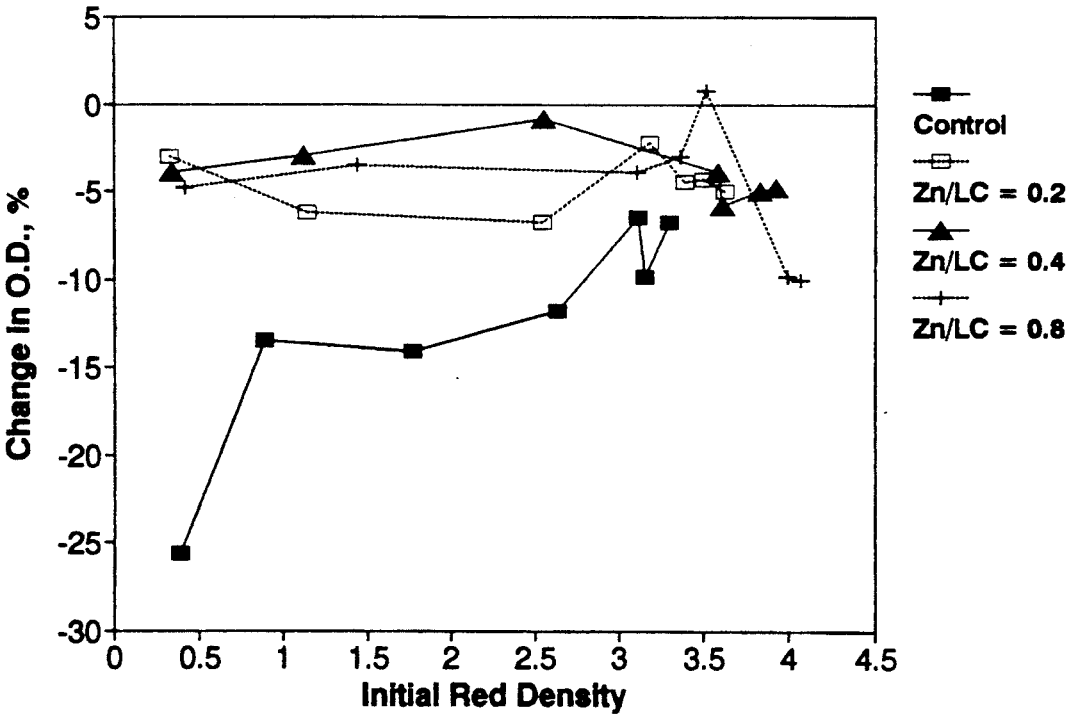
FIG. 13 shows the effect of varying amounts of zinc cation in preventing fading of images produced from a cyan color-forming compound, as described in Example 7 below.

Also, from Table 7 and FIG. 13 it will be seen that the addition of zinc substantially reduced the fading experienced in the control medium after 10 minutes of projector exposure; however, zinc at a leuco dye:zinc molar ratio of 1:0.8 was no more effective in preventing fading that at a molar ratio of 1:0.4.

EXAMPLE 8

This Example illustrates the effect of copper(II) and cobalt(II) cations in reducing projector fading of images formed from imaging media containing the cyan leuco dye of Formula IV above.

Figure 14:
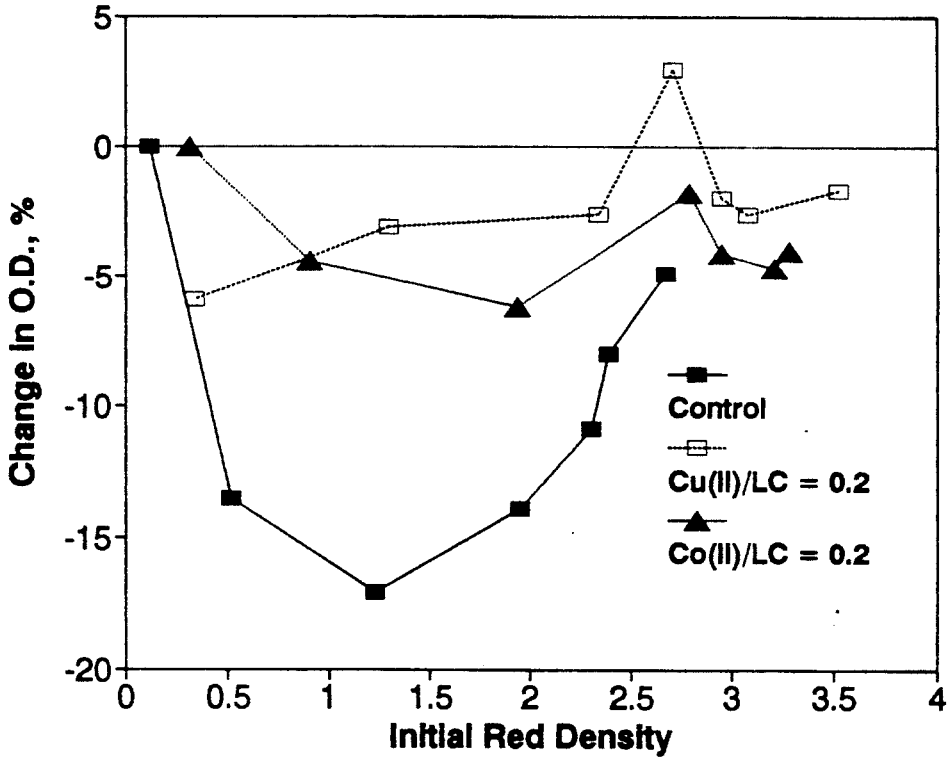
FIG. 14 shows the effect of copper(II) and cobalt(II) cations in preventing fading of images produced from a cyan color-forming compound, as described in Example 8 below.

The media used in this experiment were the same as in Example 1 above. Three media were prepared, a control in which the cyan color-forming layer contained no metal cations, and two others in which the color-forming layer contained, respectively, copper(II) acetate and cobalt(II) acetate at a leuco dye:metal molar ratio of 1:0.2. These three media were imaged and their optical densities recorded in the same way as in Example 1, except that a 785 nm laser was used for imaging. These images were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table 8 below and plotted in FIG. 14 of the accompanying drawings, in which the percentage change in optical density of the images is plotted against the initial red optical density.

TABLE 8

| Optical Density at 785 nm | Control 1.04 | | Cu/LC = 0.2 1.48 | | Co/LC = 0.2 1.12 | |
|---|---|---|---|---|---|---|
| Writing Speed, m/s | Initial Red Density | Change in O.D., % | Initial Red Density | Change in O.D., % | Initial Red Density | Change in O.D., % |
| 0.14 | 2.67 | −4.9 | 2.34 | −2.6 | 2.79 | −1.8 |
| 0.16 | 2.39 | −8.0 | 2.71 | 3.0 | 3.21 | −4.7 |
| 0.18 | 2.30 | −10.9 | 2.95 | −2.0 | 3.28 | −4.0 |
| 0.22 | 1.95 | −13.9 | 3.52 | −1.7 | 2.95 | −4.1 |
| 0.26 | 1.23 | −17.1 | 3.08 | −2.6 | 1.94 | −6.2 |
| 0.32 | 0.52 | −13.5 | 1.30 | −3.1 | 0.91 | −4.4 |
| 0.42 | 0.12 | 0.0 | 0.34 | −5.9 | 0.32 | 0.0 |

Figure 15:
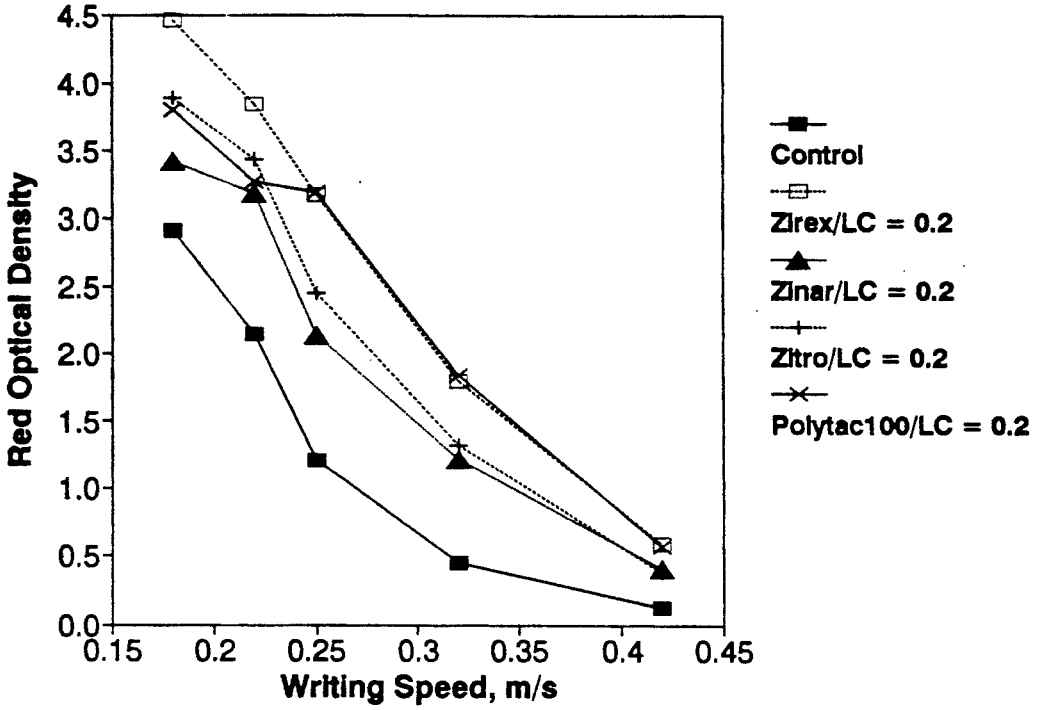
FIG. 15 shows the effect of various zinc rosinates in increasing the sensitivity of a thermal imaging medium containing a cyan color-forming compound, as described in Example 9 below.

From Table 8 and FIG. 15 it will be seen that the addition of copper(II) or cobalt(II) substantially reduced the fading experienced in the control medium after 10 minutes of projector exposure.

EXAMPLE 9

This example illustrates the effect of zinc rosinates in increasing sensitivity of, and reducing projector fading of images formed from, imaging media containing the cyan leuco dye of Formula IV above.

PART A: SENSITIVITY EXPERIMENTS

The media used in this experiment were the same as in Example 1 above. Five media were prepared, a control in which the cyan color-forming layer contained no zinc, and four others in which the color-forming layer contained one of the zinc rosinates Zirex, Zinar, Zitro and Polytac100 (Zirex, Zinar, Zitro and Polytac100 are all Registered Trademarks) at a leuco dye:zinc molar ratio of 1:0.2. These five media were imaged and their optical densities recorded in the same way as in Example 1, except that an 784 nm laser was used. The results are shown in Table 9 below and plotted in FIG. 15 of the accompanying drawings.

PART B: PROJECTOR FADING EXPERIMENTS

The images produced in Part A above were placed in a Kodak Ektagraphic Model AF-2 slide projector (equipped with a Sylvania tungsten-halogen ELH 300 W 120 V bulb) for 10 minutes with the projector on the high setting, and the red optical densities of the various areas of the images remeasured following projector exposure in the same manner as before. The results are shown in Table 9 below and plotted in FIG. 16 of the accompanying drawings, in which the percentage change in optical density of the images is plotted against the initial red optical density.

TABLE 9

| Optical Density at 784 nm | Control 0.85 | | Zirex/LC = 0.2 0.87 | | Zinar/LC = 0.2 0.86 | | Zitro/LC = 0.2 0.87 | | Polytac100/LC = 0.2 0.88 | |
|---|---|---|---|---|---|---|---|---|---|---|
| Writing Speed, m/s | Initial Red Density | Change in O.D., % | Initial Red Density | Change in O.D., % | Initial Red Density | Change in O.D., % | Initial Red Density | Change in O.D., % | Initial Red Density | Change in O.D., % |
| 0.18 | 2.91 | −6.9 | 4.46 | −0.5 | 3.42 | 4.4 | 3.89 | −3.1 | 3.80 | −4.5 |
| 0.22 | 2.15 | −7.9 | 3.85 | −1.6 | 3.18 | −2.5 | 3.44 | 0.0 | 3.27 | 2.8 |
| 0.25 | 1.21 | −8.3 | 3.17 | −2.2 | 2.14 | 0.5 | 2.46 | 0.8 | 3.19 | −1.6 |
| 0.32 | 0.45 | −2.2 | 1.80 | −1.7 | 1.22 | −4.1 | 1.33 | 0.0 | 1.84 | −1.6 |
| 0.42 | 0.13 | −7.7 | 0.59 | −1.7 | 0.41 | 0.0 | 0.38 | −7.9 | 0.57 | 0.0 |

From Table 9 and FIG. 15 it will be seen that the zinc rosinate-containing media produced higher optical densities at a given writing speeds than that produced by the control medium; in fact, the Zirex/LC=0.2 medium showed a 190% increase in sensitivity, the Zinar/LC=0.2 medium showed a 106% increase in sensitivity, the Zitro/LC=0.2 medium showed a 117% increase in sensitivity, and the Polytac100/LC=0.2 medium showed a 188% increase in sensitivity, all calculated over the full range of writing speeds of 0.18−0.42 m/s. Thus, the addition of zinc rosinates to the cyan imaging layer rendered the medium more sensitive.

Figure 16:
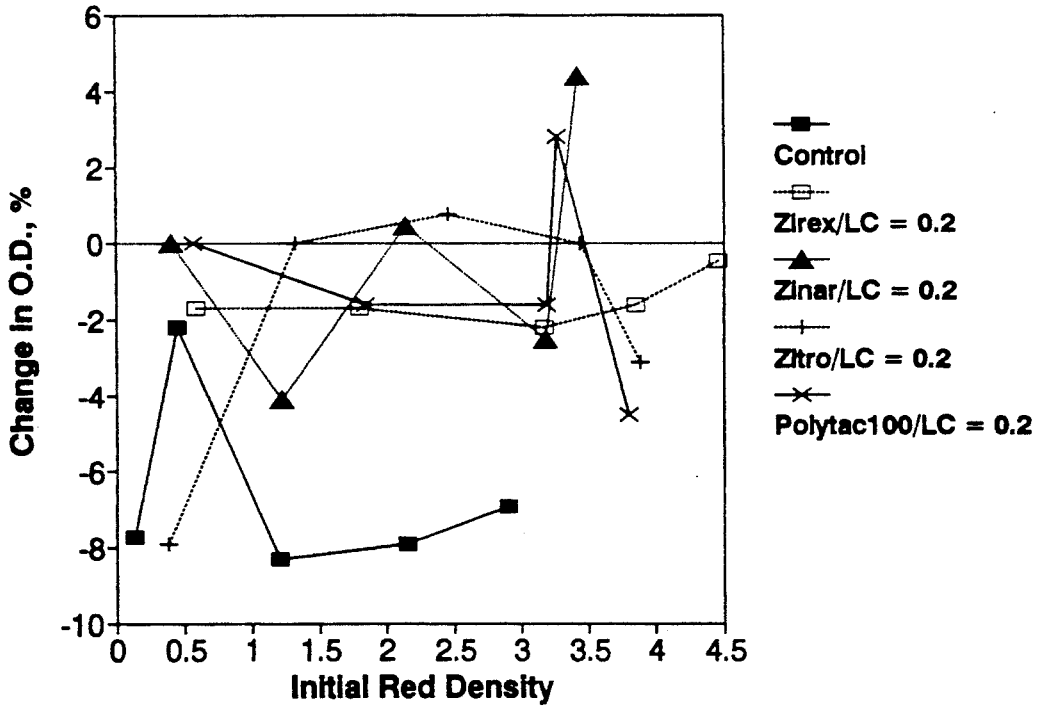
FIG. 16 shows the effect of various zinc rosinates in preventing fading of images produced from a cyan color-forming compound, as described in Example 9 below.

Also, from Table 9 and FIG. 16 it will be seen that the addition of zinc rosinate substantially reduced the fading experienced in the control medium after 10 minutes of projector exposure.

From the foregoing it will be seen that the addition of a source of zinc, nickel, copper(II), cobalt(II) or aluminum(III) cations to the imaging layer of a thermal imaging medium in accordance with the present invention is effective in increasing the sensitivity of the imaging medium and in reducing projector fading of images produced therefrom.

We claim:

1. A thermal imaging medium comprising at least one imaging layer, the imaging layer comprising a binder and a color-forming compound which undergoes a change of color upon heating above a color-forming temperature for a color-forming time, the color-forming compound being of the formula:

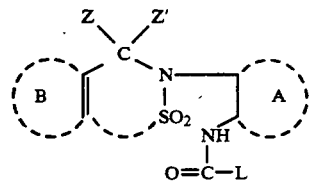

and forming after its change in color a dye compound of the formula:

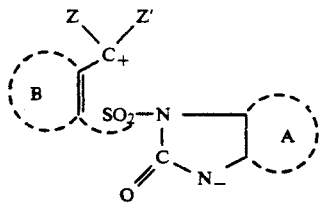

in which formulae:

rings A and B are aromatic nuclei;

Z and Z', which may be linked other than via the meso carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating;

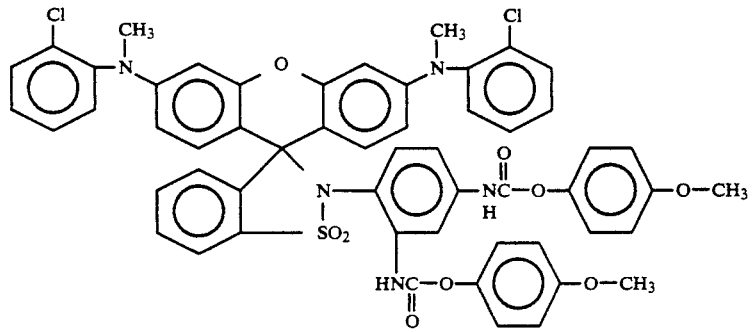

or

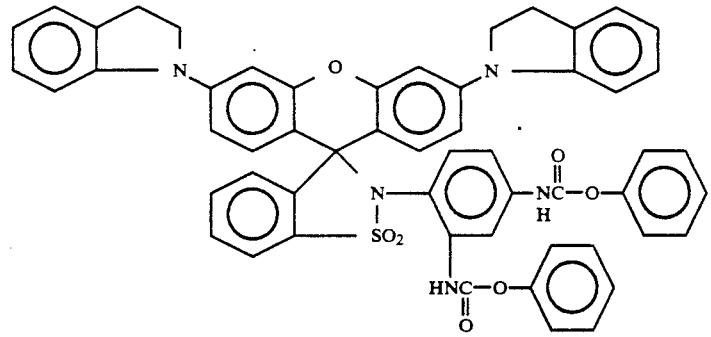

and the broken line between the $SO_2$ group and ring B denotes that the sulfonamide ring in the color-forming compound may be 5- or 6-membered, the imaging layer further comprising a source of zinc, nickel, copper(II), cobalt(II) or aluminum(III) cations.

2. An imaging medium according to claim 1 wherein the imaging layer comprises a source of zinc cations.

3. An imaging medium according to claim 2 wherein the source of zinc cations comprises a zinc carboxylate.

4. An imaging medium according to claim 3 wherein the source of zinc cations comprises zinc acetate or isobutyrate.

5. An imaging medium according to claim 1 wherein the imaging layer comprises a zinc or nickel rosinate.

6. An imaging medium according to claim 1 wherein the source can provide at least about 0.1 mole of the metal cations per mole of color-forming compound.

7. An imaging medium according to claim 6 wherein the source can provide at least about 0.25 mole of the metal cations per mole of color-forming compound.

8. An imaging medium according to claim 1 wherein, in the color-forming and dye compounds, Z and Z' each comprise a benzene ring, Z and Z' being linked via an oxygen atom bonded to the two benzene rings at positions ortho to the meso carbon atom, so that the Z-C-Z' grouping forms a xanthene nucleus.

9. An imaging medium according to claim 8 wherein the benzene rings of Z and Z' carry substituted amino groups at positions para to the meso carbon atom.

10. An imaging medium according to claim 1 wherein, in the color-forming compound, ring A comprises a benzene ring bearing, at its position para to the sulfonamide nitrogen atom, a carbamate moiety.

11. An imaging medium according to claim 1 wherein the color-forming compound comprises:

12. An imaging medium according to claim 1 wherein the color change of the color-forming compound is from colorless to colored.

13. An imaging medium according to claim 1 further comprising an absorber capable of absorbing infra-red radiation and thereby generating heat in the imaging layer and promoting the color change of the color-forming compound.

14. An imaging medium according to claim 12 having at least two imaging layers, the at least two imaging layers comprising color-forming compounds arranged to produce dye compounds having differing colors, and comprising at least two absorbers absorbing at differing wavelengths.

15. A process for forming an image, the process comprising:

providing a thermal imaging medium having at least one imaging layer, the imaging layer comprising a binder and a color-forming compound of the formula:

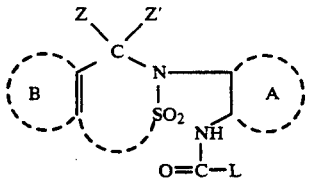

and a source of zinc, nickel, copper(II), cobalt(II) or aluminum(III) cations;

imagewise heating the imaging layer above a color-forming temperature for a color-forming time, thereby causing, in heated regions of the image, at least part of the color-forming compound to be converted to a dye compound of the formula:

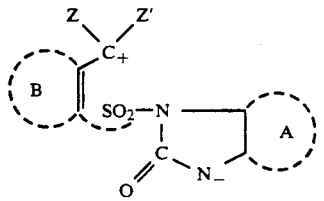

in which formulae:

rings A and B are aromatic nuclei;

Z and Z', which may be linked other than via the intervening carbon atom, represent the moieties sufficient to complete the auxochromophoric system of a diarylmethane or a triarylmethane dye in the dye compound, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, thereby forming an image.

16. A process according to claim 15 wherein the imaging layer comprises a source of zinc cations.

17. A process according to claim 16 wherein the source of zinc cations comprises a zinc carboxylate.

18. A process according to claim 17 wherein the source of zinc cations comprises zinc acetate or isobutyrate.

19. A process according to claim 15 wherein the source of metal cations comprises a zinc or nickel rosinate.

20. A process according to claim 15 wherein the source can provide at least about 0.1 mole of the metal cations per mole of color-forming compound.

21. A process according to claim 20 wherein the source can provide at least about 0.25 mole of the metal cations per mole of color-forming compound.

22. A process according to claim 15 wherein, in the color-forming and dye compounds, Z and Z' each comprise a benzene ring, Z and Z' being linked via an oxygen atom bonded to the two benzene rings at positions ortho to the meso carbon atom, so that the Z-C-Z' grouping forms a xanthene nucleus.

23. A process according to claim 22 wherein the color-forming compound comprises:

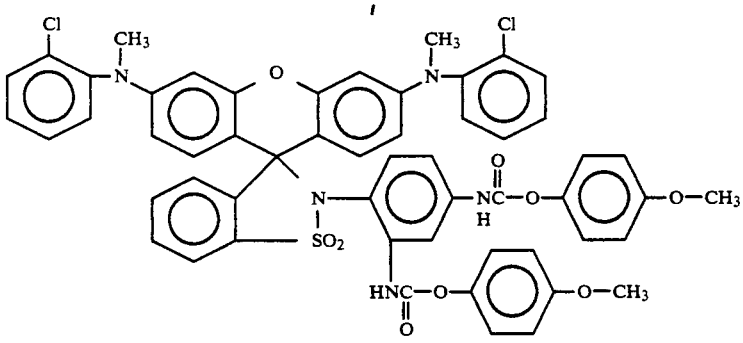

or

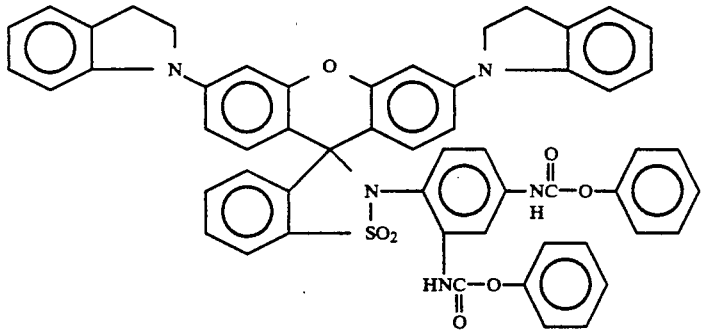

24. A process according to claim 15 wherein the imaging medium further comprises an absorber capable of absorbing infra-red radiation and thereby generating heat in the imaging layer, and wherein the imagewise heating of the imaging layer is effected by imagewise exposure of the imaging medium to infra-red radiation.

25. A process according to claim 24 wherein the imaging medium has at least two imaging layers, the at least two imaging layers comprising color-forming compounds arranged to produce dye compounds having differing colors, the imaging medium further comprising at least two absorbers absorbing at differing wavelengths, and wherein the at least two imaging layers are independently imaged by imagewise exposure of the imaging medium to infra-red radiation of at least two differing wavelengths capable of being absorbed by the absorbers.

26. A process according to claim 15 wherein the image produced is projected by passing visible radiation through the image and wherein the source of the metal cations present in the imaging medium reduces fading of the image during projection.

27. An imaged medium having imagewise colored and substantially uncolored areas, the substantially uncolored areas of the image comprising a binder and a color-forming compound which undergoes a change of color upon heating above a color-forming temperature for a color-forming time, the color-forming compound being of the formula:

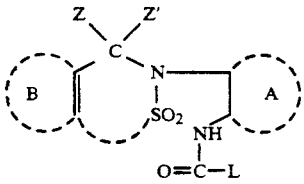

and the colored areas of the image comprising a binder and a dye compound of the formula:

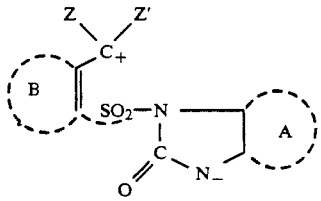

in which formulae:

rings A and B are aromatic nuclei;

Z and Z', which may be linked other than via the intervening carbon atom, represent the moieties sufficient to complete the auxochromophoric system of a diarylmethane or a triarylmethane dye, Z and Z' being such that the dye compound has absorption in the visible region;

L is a leaving group which is removed on heating; and the broken line between the $SO_2$ group and ring B denotes that the sulfonamide ring in the color-forming compound may be 5- or 6-membered, the colored and substantially uncolored areas further comprising a source of zinc, nickel, copper(II), cobalt(II) or aluminum(III) cations.

28. An imaged medium according to claim 27 wherein the colored and substantially uncolored areas comprise a source of zinc cations.

29. An imaged medium according to claim 28 wherein the source of zinc cations comprises a zinc carboxylate.

30. An imaged medium according to claim 29 wherein the source of zinc cations comprises zinc acetate or isobutyrate.

31. An imaged medium according to claim 27 wherein the source of metal cations comprises a zinc or nickel rosinate.

32. An imaged medium according to claim 27 wherein, in the substantially uncolored areas, the source can provide at least about 0.1 mole of the metal cations per mole of color-forming compound.

33. An imaged medium according to claim 32 wherein, in the substantially uncolored areas, the source can provide at least about 0.25 mole of the metal cations per mole of color-forming compound.

34. An imaged medium according to claim 27 wherein, in the color-forming and dye compounds, Z and Z' each comprise a benzene ring, Z and Z' being linked via an oxygen atom bonded to the two benzene rings at positions ortho to the meso carbon atom, so that the Z-C-Z' grouping forms a xanthene nucleus.

35. An imaged medium according to claim 27 wherein the color-forming compound comprises:

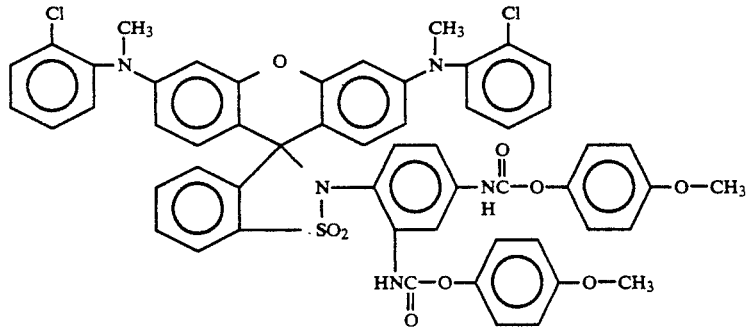

or

-continued
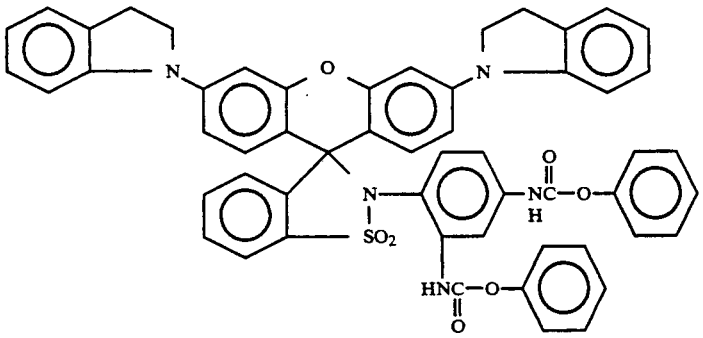
36. An imaged medium according to claim 27 wherein the substantially uncolored areas further comprise an absorber capable of absorbing infra-red radiation and thereby generating heat.
* * * * *